US012467461B2

(12) United States Patent
Erlich et al.

(10) Patent No.: US 12,467,461 B2
(45) Date of Patent: Nov. 11, 2025

(54) FLUID VACUUM PUMP

(71) Applicant: Water Tech, LLC, East Brunswick, NJ (US)

(72) Inventors: Guy Erlich, West Allenhurst, NJ (US); Curtis Elliott, Washington, NJ (US); Thomas Lorys, Linden, NJ (US); Kunwar Sethi, South River, NJ (US); Daniel Camisi, Tabernacle, NJ (US); Timothy Morales, Rumson, NJ (US)

(73) Assignee: Water Technology, LLC, East Brunswick, NJ (US)

( * ) Notice: Subject to any disclaimer, the term of this patent is extended or adjusted under 35 U.S.C. 154(b) by 378 days.

(21) Appl. No.: 17/144,743

(22) Filed: Jan. 8, 2021

(65) Prior Publication Data

US 2021/0207604 A1 Jul. 8, 2021

Related U.S. Application Data

(60) Provisional application No. 62/958,434, filed on Jan. 8, 2020.

(51) Int. Cl.
*F04D 13/02* (2006.01)
*F04D 13/08* (2006.01)
(Continued)

(52) U.S. Cl.
CPC ..... *F04D 13/02* (2013.01); *F04D 13/08* (2013.01); *F04D 13/12* (2013.01); *F04D 25/16* (2013.01); *F04D 31/00* (2013.01)

(58) Field of Classification Search
CPC ..... F04D 13/08; F04D 25/026; F04D 29/18; F04D 31/00; F04D 13/02; F04D 13/12; F04D 25/16; F16D 41/00; F16D 11/16
See application file for complete search history.

(56) References Cited

U.S. PATENT DOCUMENTS 2,223,592 A 12/1940 Barton et al.
2,274,763 A * 3/1942 Witt ..... F04D 13/14 415/99

(Continued)

FOREIGN PATENT DOCUMENTS

AU 4890190 A * 8/1990
CN 203584831 U 5/2014

(Continued)

OTHER PUBLICATIONS

English Machine Translation of DE-10101099-A1 (Year: 2002).*
Extended European Search Report from corresponding European Patent Application Serial No. 21738140.9 issued Mar. 26, 2024.

*Primary Examiner* — Nathan C Zollinger
(74) *Attorney, Agent, or Firm* — Husch Blackwell LLP

(57) ABSTRACT

A fluid vacuum pump includes a motor assembly including a single motor or multiple motors, where one motor may be configured for operation in a first medium and another motor may be configured for operation in a second medium; an impeller assembly including a single impeller, which may of a fixed or variable configuration, or multiple impellers, where one impeller may be configured for operation in a first medium and another impeller may be configured for operation in a second medium; and a linkage operatively connecting and adjustably transmitting power from the motor assembly to the impeller depending on the type of medium present.

26 Claims, 35 Drawing Sheets

(51) Int. Cl.

| | |
|---|---|
| ***F04D 13/12*** | (2006.01) |
| ***F04D 25/16*** | (2006.01) |
| ***F04D 31/00*** | (2006.01) |

(56) References Cited

U.S. PATENT DOCUMENTS

| | | | | |
|---|---|---|---|---|
| 2,803,396 | A * | 8/1957 | Darrow | F04D 29/681 415/26 |
| 2,877,710 | A | 3/1959 | Barnhart | |
| 3,981,628 | A | 9/1976 | Carter | |
| 4,576,552 | A * | 3/1986 | Smith | F04D 15/0218 417/32 |
| 6,082,974 | A * | 7/2000 | Takemoto | F04D 29/426 417/423.12 |
| 6,119,304 | A | 9/2000 | Berfield et al. | |
| 8,516,650 | B2 * | 8/2013 | Beers | A47L 9/2889 15/319 |
| 9,752,590 | B2 * | 9/2017 | Rosinski | F04D 13/14 |
| 10,219,663 | B2 * | 3/2019 | Fox | E03F 7/10 |
| 2002/0042965 | A1 | 4/2002 | Salem et al. | |
| 2003/0049138 | A1 | 3/2003 | Lopes et al. | |
| 2005/0055795 | A1 | 3/2005 | Zeiler et al. | |
| 2009/0123293 | A1 * | 5/2009 | Gierer | A47L 9/22 417/17 |
| 2014/0044564 | A1 | 2/2014 | Hampton | |
| 2014/0271123 | A1 | 9/2014 | Rosinski | |
| 2018/0184626 | A1 | 7/2018 | Moon et al. | |

FOREIGN PATENT DOCUMENTS

| | | | | |
|---|---|---|---|---|
| DE | 2509663 | A1 | 9/1976 | |
| DE | 10101099 | A1 * | 7/2002 | F04D 15/0245 |
| DE | 102014220377 | A1 | 4/2016 | |
| JP | 11201078 | A | 7/1999 | |
| JP | 2016089769 | A | 5/2016 | |
| KR | 101796581 | B1 | 12/2017 | |

* cited by examiner

AIR PUMPING CONFIGURATION

WATER PUMPING CONFIGURATION

AIR PUMPING

WATER PUMPING

AIR CONFIGURATION

WATER CONFIGURATION

WATER CONFIGURATION

AIR CONFIGURATION

FLUID VACUUM PUMP

CROSS REFERENCE

This application claims the priority of, and expressly incorporates by reference herein the entire disclosure of, U.S. Provisional Patent Application No. 62/958,434, filed Jan. 8, 2020.

FIELD OF THE INVENTION

The present invention relates to fluid filtration and vacuum devices, and more specifically for pumping systems for such filtration devices that are suitable for both direct submersion into a body of water to be filtered and use outside of a body of water.

BACKGROUND OF THE INVENTION

Manually operated submersible water filtration apparatuses, such as pool cleaners, many of which use suction to clean bodies of water in need of periodic cleaning—such as swimming pools or spas—generally take the form of hand-held cleaning devices and/or extension pole driven cleaning devices. Both are inexpensive and suitable for cleaning smaller sized bodies of water, such as swimming pools and spas. Other types of pool cleaning devices, such as self-propelled robotic pool cleaners, are often more appropriate for larger volume swimming pools and spas. Similarly, there are many vacuums that are well suited for use on dry surfaces, both around pools and elsewhere around a residential or commercial area.

While these filtration devices and vacuum devices can be quite effective for their intended environment of use, they are not reasonably effective in other possible environments. This is due in significant part to the fundamental differences of the media—i.e. air versus water—in which each category of device is designed to operate. Drawing air through a vacuum inlet is relatively easy given the low mass and density of the medium. However, air is also compressible, which requires a high-speed impeller or propeller with a significant number of larger blades. In contrast, water is both extremely dense and generally incompressible. Therefore, in order to draw water into a filtration intake, an impeller or propeller system using lower velocities and/or fewer blades are generally used. These differences make using an air vacuum in a water environment or a water filtration device in an air environment difficult as the RPMs, torques, and current draws used in each type of system are not suited for the other environment and can result in motor damage or failure or ineffective operation. Further, in the case of battery powered versions of these devices, such cross-environment use, even if it does not result in motor damage, frequently results in rapid battery discharging or damage.

Therefore, it is currently necessary for a user to switch completely from one type of cleaning device to the other in order to clean in these different environments. Particularly, in environments that may contain areas involving both wet and dry environments, this can require relocating and switching between multiple cleaning tools to complete the required cleaning task. This results in lost time and, needless to say, a significantly greater required investment in purchasing multiple devices.

Therefore, it would be desirable to have a single device that operates effectively in both water and air environments and is also suitable for use with either batteries or external power sources.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later. It should be understood that, although air and water are mentioned throughout the present disclosure, they are referenced solely for illustrative purposes and should not be considered limiting. The systems and methods described herein are designed for use with two or more fluids having different densities, or viscosities, etc. such that the differing kinematic forces of each fluid can be used and/or detected in such a way that the appropriate pumping system or systems are activated. Fluids can consist of air, water, oil, or other substances. The present disclosure contemplates pumping systems that may be configured for use in two or more fluid environments.

In accordance with one aspect of the present disclosure, there is provided a fluid vacuum pump that includes a motor assembly including a single motor or multiple motors, where one motor may be configured for operation in a first medium and another motor may be configured for operation in a second medium; an impeller assembly including a single impeller, which may have a fixed or variable configuration, or multiple impellers, where one impeller may be configured for operation in a first medium and another impeller may be configured for operation in a second medium; and a linkage operatively connecting and adjustably transmitting power from the motor assembly to the impeller depending on the type of medium present.

In another aspect, there is provided a fluid vacuum pump that includes a linkage having at least one of a linking mechanism and a clutch mechanism configured to adjustably transmit power from the motor assembly to the impeller assembly.

In another aspect, there is provided a fluid vacuum pump that includes a linkage configured to operatively connect a first motor with a first impeller and to operatively connect a second motor with a second impeller; and a selection device configured to direct power to one of the first motor or the second motor depending on the medium present.

In yet another aspect, there is provided a fluid vacuum pump that includes a first impeller further with a first impeller gear and a second impeller with a second impeller gear; and a linkage having a movable clutch gear selectively engaging a motor with at least one of the first impeller gear and the second impeller gear.

In another aspect, there is provided a fluid vacuum pump that includes a selection device directing movement of at least one movable clutch gear.

In yet another aspect, there is provided a fluid vacuum pump that includes a kinematic clutch directing movement of at least one movable clutch gear between engagement with a first impeller gear and a second impeller gear.

In another aspect, there is provided a fluid vacuum pump that includes a the impeller with a blade configuration suitable for use in multiple mediums; a linkage having at least one linking gear transmitting power from at least one of a first or a second motors to the impeller; and a selection device selectively directing power to at least one of the motors depending on the medium present.

In yet another aspect, there is provided a fluid vacuum pump that includes a impeller with a blade configuration suitable for use in multiple mediums; a linkage having a movable clutch gear engaged with the impeller and selectively engaging one of a first impeller gear and a second impeller gear; and a kinematic clutch directing movement of the movable clutch gear between engagement with the first impeller gear and the second impeller gear; and a selection device selectively directing power to at least one of two motors depending on the medium present.

In another aspect, there is provided a fluid vacuum pump that includes a variable configuration impeller. The variable configuration impeller may have first and second sections, with the first section being configured for operation in a first medium. The second section may be configured for operation in a second medium either alone or in combination with the first section.

In yet another aspect, there is provided a fluid vacuum pump that includes a linkage with a clutch configured to selectively engage and disengage at least one of two sections of a variable configuration impeller depending on the medium present.

In yet another aspect, there is provided a fluid vacuum pump that includes a variable configuration impeller having a first section with a first magnet and a second section with a second magnet and wherein the first magnet and the second magnet are configured to selectively couple the first and second sections depending on the medium present.

In yet another aspect, there is provided a fluid vacuum pump that includes a variable configuration impeller having a first section with a first magnet and a second section with a second magnet and a linkage having a clutch configured to selectively engage and disengage at least one of the first and second sections depending on the medium present.

In yet another aspect, there is provided a fluid vacuum pump that includes a variable configuration impeller having a first section with a first magnet and a second section with a second magnet and a kinematic clutch.

In yet another aspect, there is provided a fluid vacuum pump that a variable configuration impeller having a first section with a first magnet and a second section with a second magnet and where the first and second magnets form a clutch.

In yet another aspect, there is provided a fluid vacuum pump that includes a variable configuration impeller having a first section and a second section and a brake configured to selectively engage one of the first or second sections to affect rotation of an engaged section relative to an unengaged section depending on the medium present.

In yet another aspect, there is provided a fluid vacuum pump that includes a brushless motor system.

In yet another aspect, there is provided a fluid vacuum pump that includes a variable configuration impeller having a first section and a second section and a one-way clutching mechanism configured to selectively engage and disengage at least one of the first and second sections depending upon a direction of rotation of the first section.

In yet another aspect, there is provided a fluid vacuum pump that includes at least one sensor configured to detect the medium present and a selection device in communication with the sensor and configured to adjust transmission of power to a motor assembly depending on the medium detected by the sensor.

In yet another aspect, there is provided a fluid vacuum pump that includes a motor assembly; an impeller assembly; and a linkage adjustably transmitting power from the motor assembly to the impeller assembly depending on a medium present.

In yet another aspect, there is provided a fluid vacuum pump that includes a motor assembly; an impeller assembly; and a selection device adjustably controlling at least one of the motor assembly and the impeller assembly depending on a medium present.

These aspects are merely illustrative of the innumerable aspects associated with the present invention and should not be deemed as limiting in any manner. These and other aspects, features and advantages of the present invention will become apparent from the following detailed description when taken in conjunction with the referenced drawings.

BRIEF DESCRIPTION OF DRAWINGS

The foregoing summary, as well as the following detailed description will be best understood when read in conjunction with the attached drawings in which the same or similar elements are referred to by the same numerals, and where.

Figure 1:
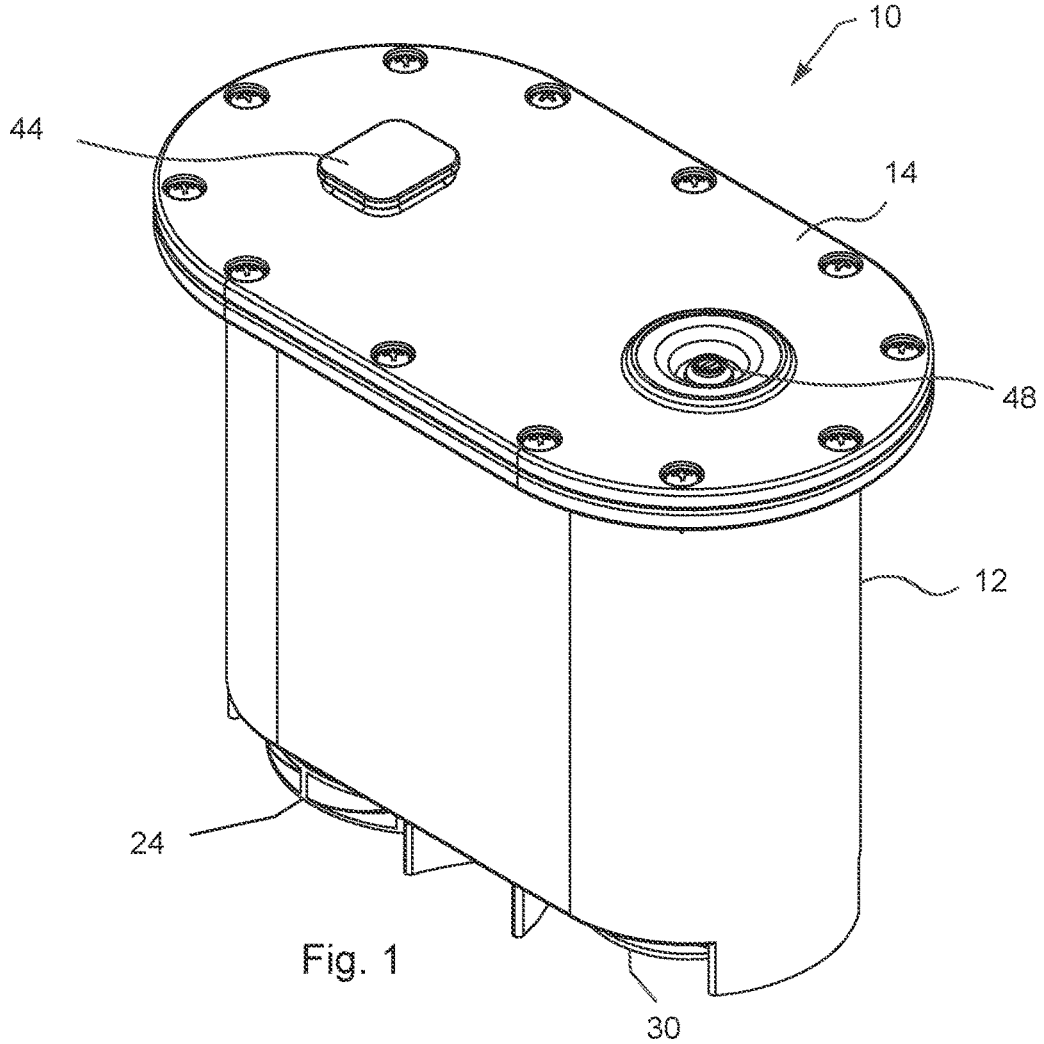
FIG. 1 is a perspective view of a fluid vacuum pump incorporating two motors and two impellers according to a first embodiment of the present disclosure.
Figure 2:
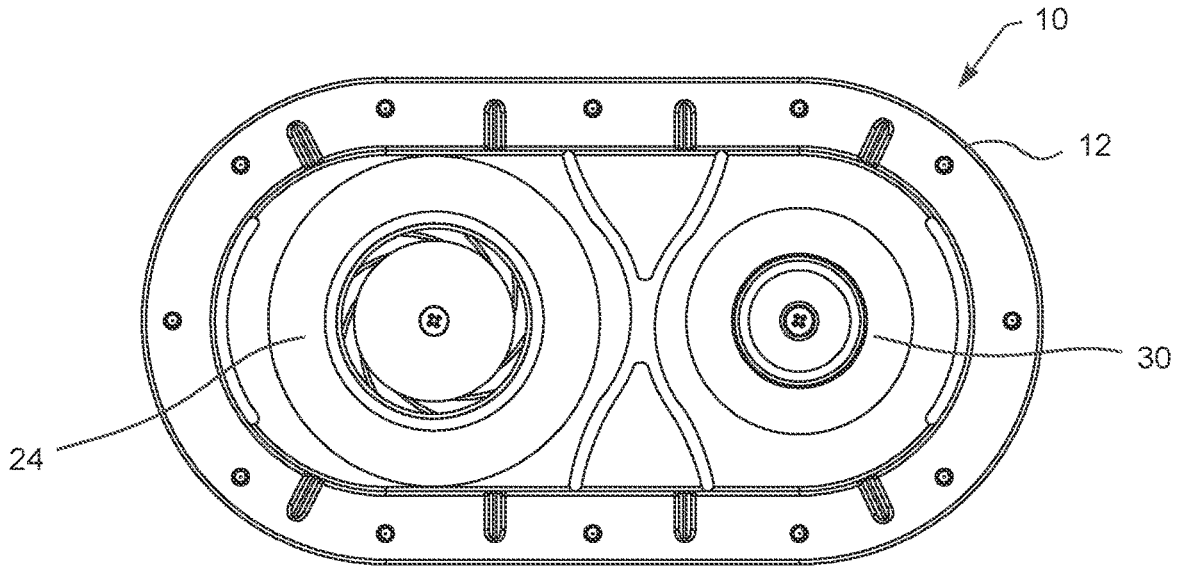
FIG. 2 is a bottom view of the fluid vacuum pump of FIG. 1.
Figure 3:
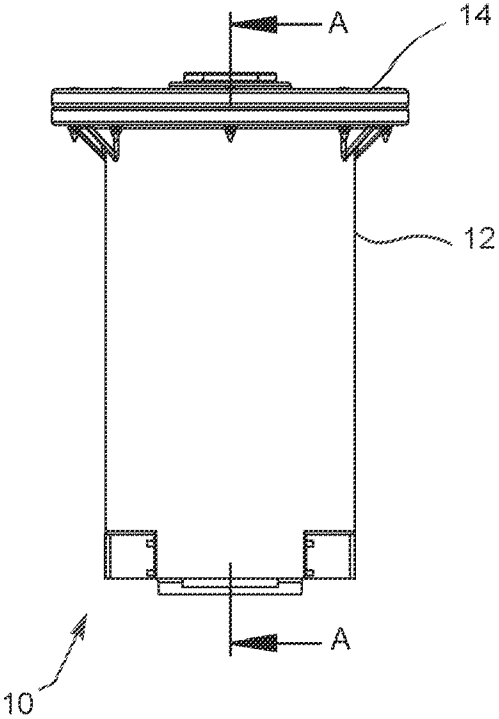
FIG. 3 is a side view of the fluid vacuum pump of FIG. 1.
Figure 3A:
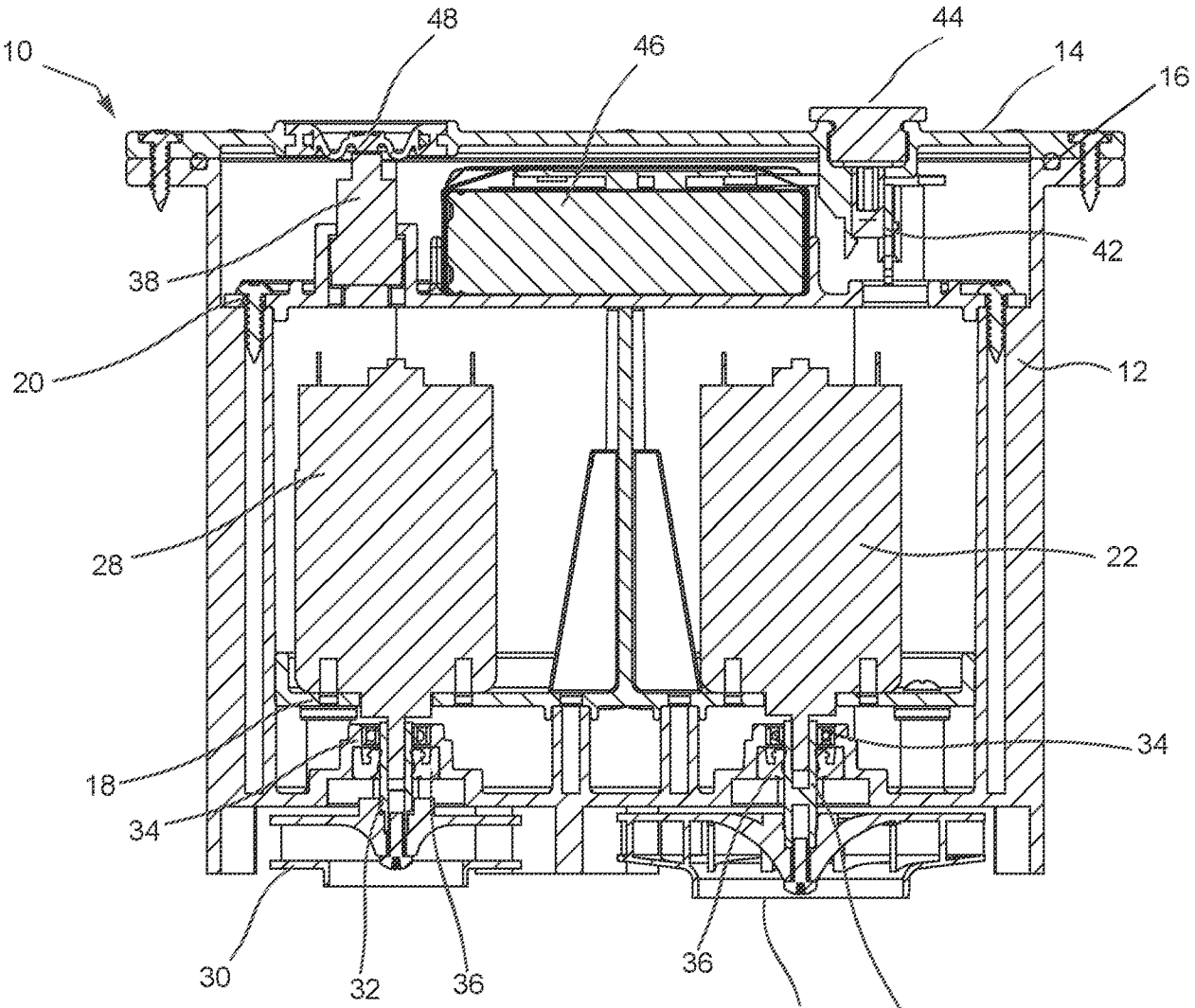
FIG. 3A is a cross-section of the fluid vacuum pump taken along the section line A-A of FIG. 3.
Figure 4:
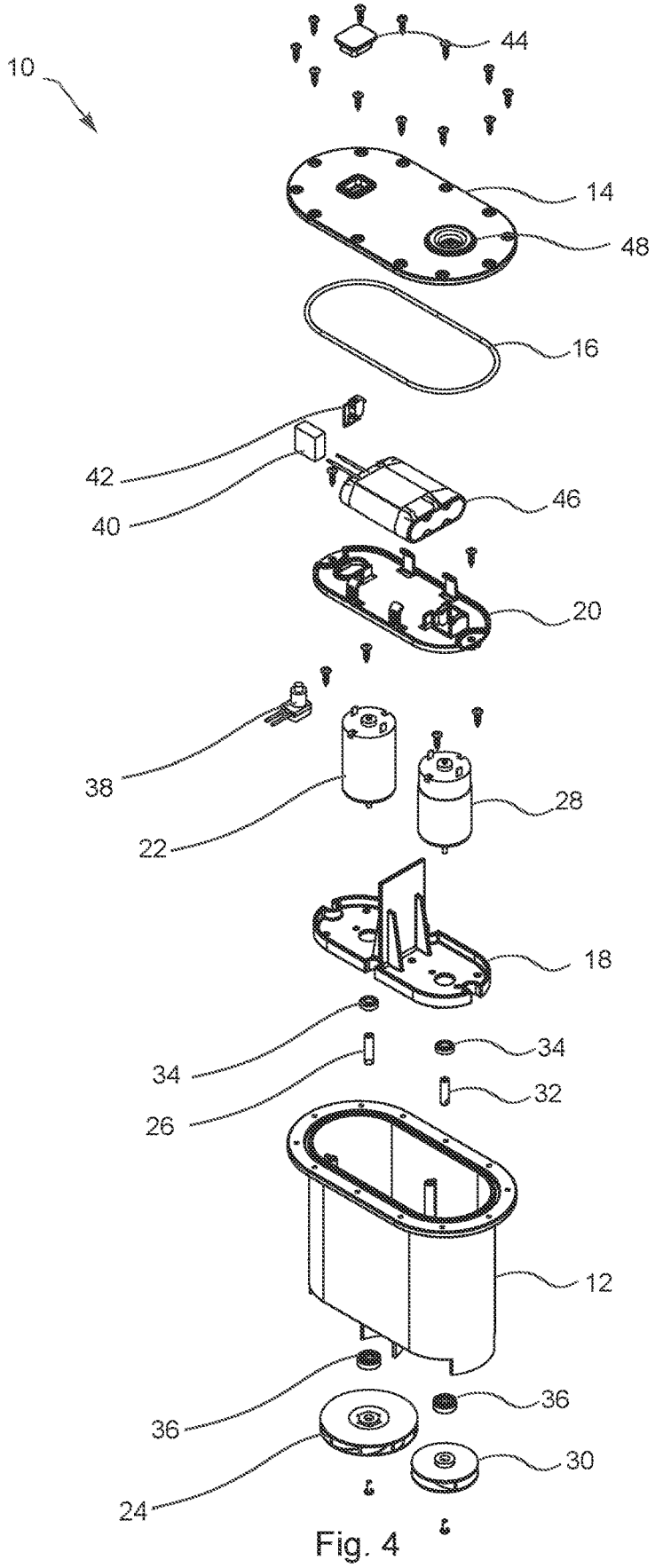
FIG. 4 is an exploded perspective view of the fluid vacuum pump of FIG. 1.
Figure 5:
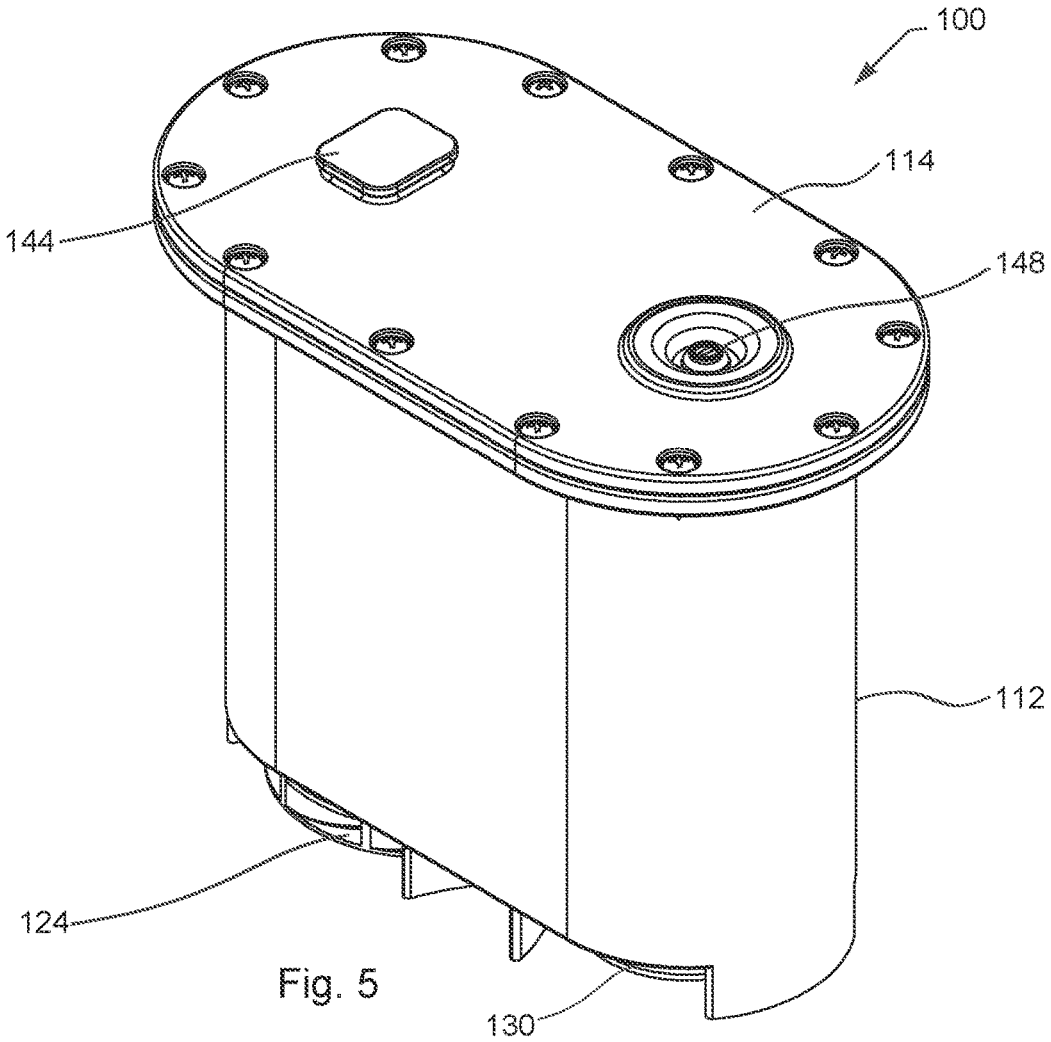
FIG. 5 is a perspective view of a fluid vacuum pump incorporating one motor and two impellers according to another embodiment of the present disclosure.
Figure 6:
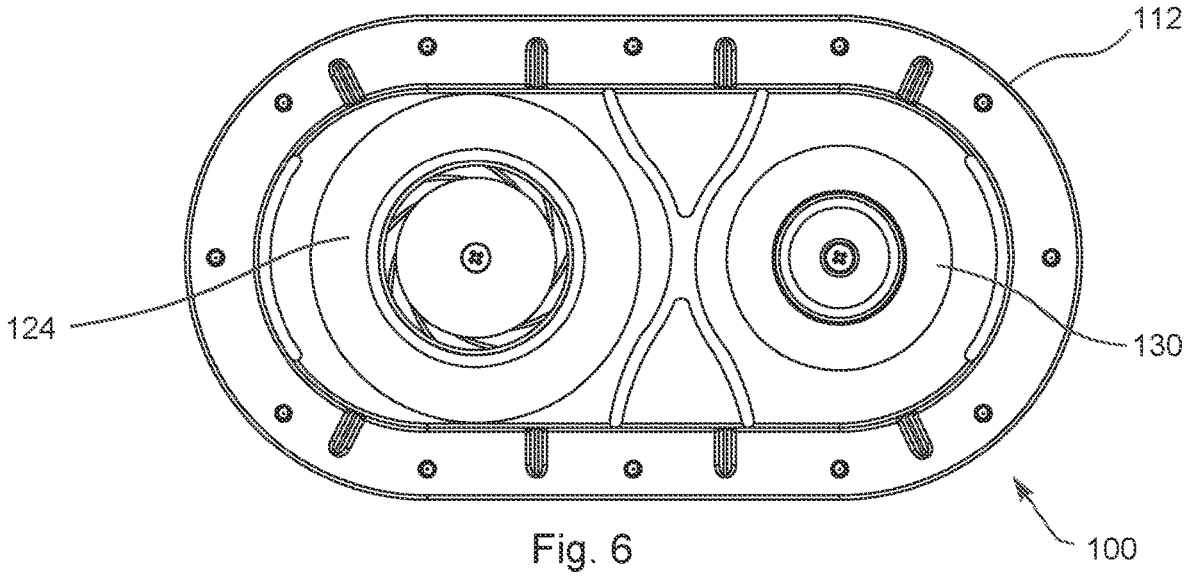
FIG. 6 is a bottom view of the fluid vacuum pump of FIG. 5.
Figure 7:
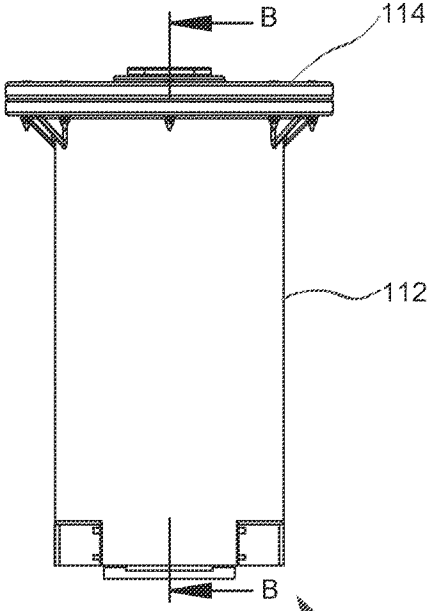
FIG. 7 is a side view of the fluid vacuum pump of FIG. 5.
Figure 7A:
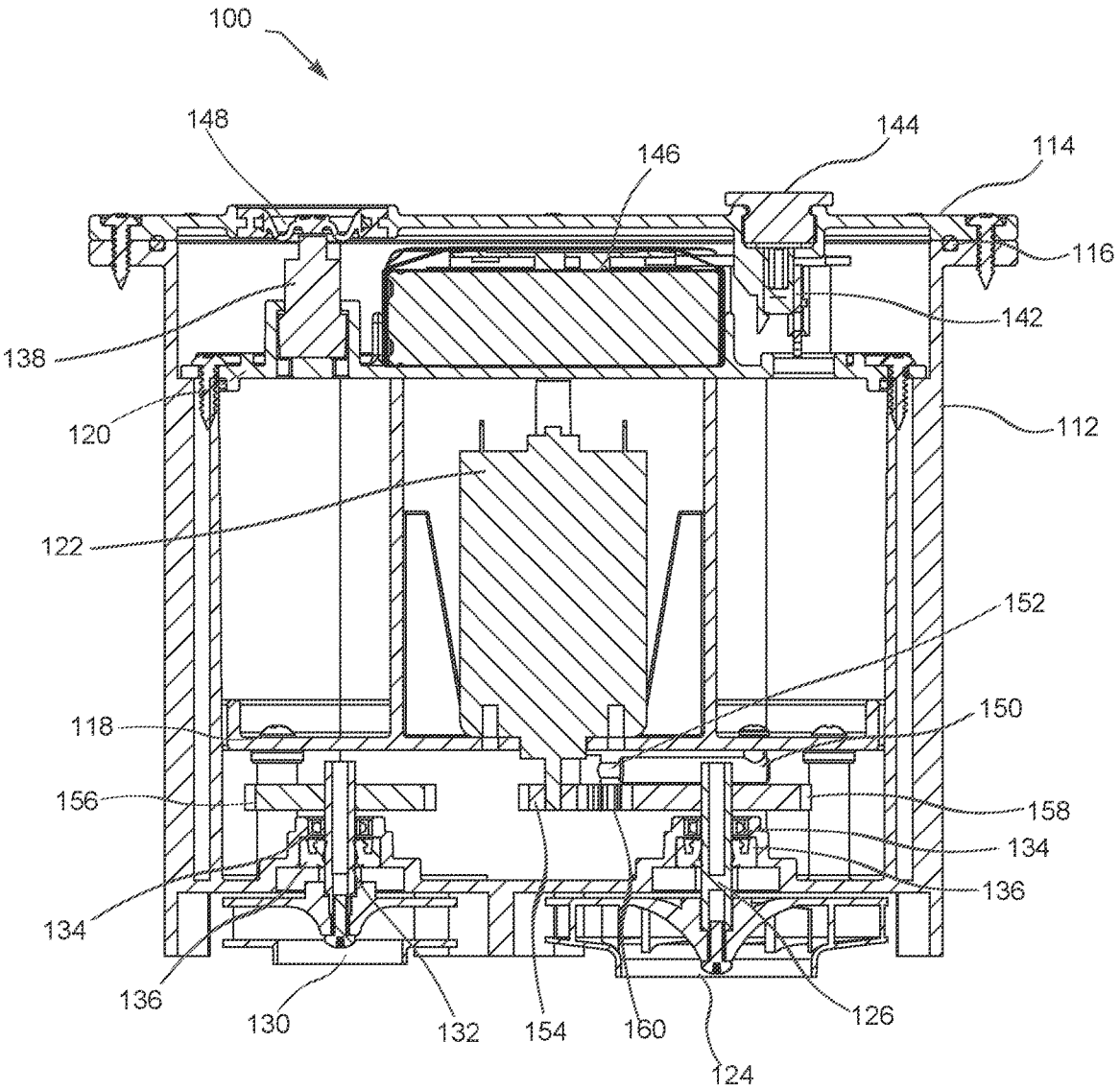
FIG. 7A is a cross-section view of the fluid vacuum pump taken along the section line B-B of FIG. 7.
Figure 8:
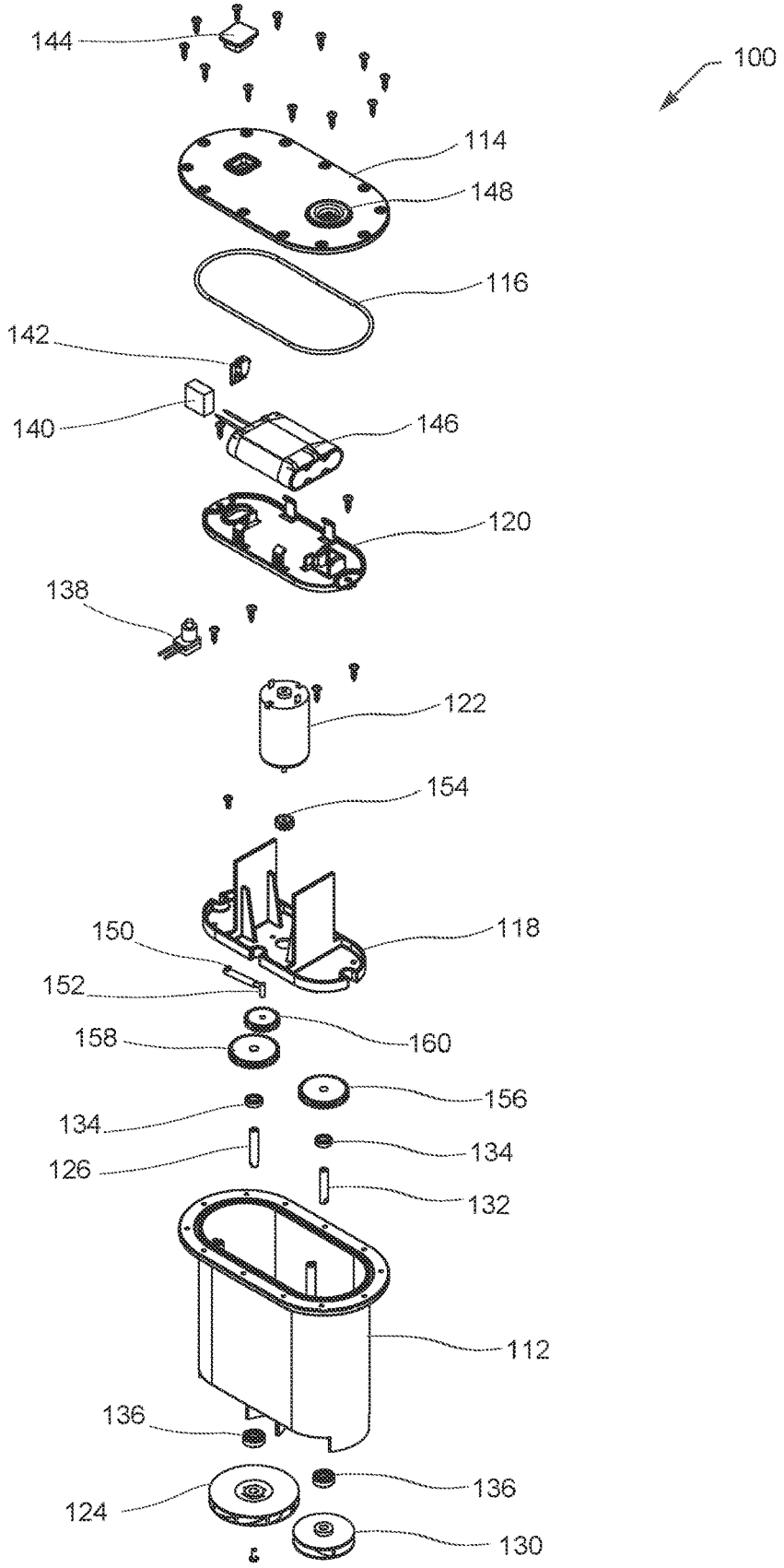
FIG. 8 is an exploded perspective view of the fluid vacuum pump of FIG. 5.

While the disclosure is susceptible to various modifications and alternative forms, specific embodiments thereof are shown by way of example in the drawings and will herein be described in detail. It should be understood, however, that the drawings and detailed description presented herein are not intended to limit the disclosure to the particular embodiment disclosed, but on the contrary, the intention is to cover all modifications, equivalents, and alternatives falling within the spirit and scope of the present disclosure.

DETAILED DESCRIPTION OF THE PREFERRED EMBODIMENTS

In the following detailed description numerous specific details are set forth in order to provide a thorough understanding of the invention. However, it will be understood by those skilled in the art that the present invention may be practiced without these specific details. For example, the invention is not limited in scope to the particular type of industry application depicted in the figures. In other instances, well-known methods, procedures, and components have not been described in detail so as not to obscure the present invention. The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. The following definitions and non-limiting guidelines must be considered in reviewing the description of the technology set forth herein.

The headings (such as "Introduction" and "Summary") and sub-headings used herein are intended only for general organization of topics within the present disclosure and are not intended to limit the disclosure of the technology or any aspect thereof. In particular, subject matter disclosed in the "Introduction" may include novel technology and may not constitute a recitation of prior art. Subject matter disclosed in the "Summary" is not an exhaustive or complete disclosure of the entire scope of the technology or any embodiments thereof. Classification or discussion of a material within a section of this specification as having a particular utility is made for convenience, and no inference should be drawn that the material must necessarily or solely function in accordance with its classification herein when it is used in any given composition.

The citation of references herein does not constitute an admission that those references are prior art or have any relevance to the patentability of the technology disclosed herein. All references cited in the "Description" section of this specification are hereby incorporated by reference in their entirety.

The description and specific examples, while indicating embodiments of the technology, are intended for purposes of illustration only and are not intended to limit the scope of the technology. Moreover, recitation of multiple embodiments having stated features is not intended to exclude other embodiments having additional features, or other embodiments incorporating different combinations of the stated features. Specific examples are provided for illustrative purposes of how to make and use the apparatus and systems of this technology and, unless explicitly stated otherwise, are not intended to be a representation that given embodiments of this technology have, or have not, been made or tested.

As used herein, the word "include," and its variants, is intended to be non-limiting, such that recitation of items in a list is not to the exclusion of other like items that may also be useful in the materials, compositions, devices, and methods of this technology. Similarly, the terms "can" and "may" and their variants are intended to be non-limiting, such that recitation that an embodiment can or may comprise certain elements or features does not exclude other embodiments of the present technology that do not contain those elements or features.

"A" and "an" as used herein indicate "at least one" of the item is present; a plurality of such items may be present, when possible. "About" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. In addition, disclosure of ranges includes disclosure of all distinct values and further divided ranges within the entire range.

The present disclosure provides multiple embodiments directed to a system for effective vacuum/filtration performance of a single device in different fluid environments, such as air and water. As noted above, the technical problem presented is engineering a system to handle multiple mediums while minimizing potential component damage and/or failure. As will be seen, the system addresses this technical problem by providing alternate motor configurations, impeller configurations—including variable configuration impellers, and gear/clutch mechanisms. The present disclosure encompasses different combinations of the basic elements presented herein. Furthermore, these embodiments are presented to further describe and disclose systems that may utilize mechanical elements other than those specifically illustrated herein.

As the various embodiments herein employ many identical or similar elements, or elements with differing characteristics that do not alter the present disclosure, those elements may be indicated with similar reference numbers (item 34 generally corresponding to 134, 234, etc.) in this written description and/or the accompanying drawing figures but not further described in later embodiments.

As used herein, reference specifically to an "air" or "water" motor is indicative of motors that are selected to have operational characteristics, including, for example, RPM setting, torque, and current draw, particularly suited for the referenced medium. Where reference is made only to "a motor", the referenced motor may have those operational characteristics that represent a compromise between the preferred operational characteristics for air versus water operation.

FIGS. 1-4 illustrate a first embodiment of the present disclosure directed to a pump (10) incorporating two motors and two impellers. Each motor/impeller combination is optimized for pumping particular fluids such as air and/or water. There could be multiple mediums present within an environment simultaneously, and both motor/impeller combinations may be run simultaneously to provide a "self-priming" effect as desired. A housing (12) encloses the internal components of pump (10). A housing cover (14) encloses the top end of the housing. The housing cover (14) includes openings to accommodate a port for access to a DC connector (42) for charging a battery (46). A connector cap (44) covers the port when the battery (46) is not being charged to protect the DC jack during use. In an alternate embodiment, the DC jack is replaced with alternate charging elements, such as inductive charging elements to eliminate the need for certain components like the connector cap. The design and use of such charging elements should not be considered limiting to the scope of this disclosure, or any disclosures described herein. The housing cover (14) also includes an opening to accommodate an on/off button (48) that controls operation of the power switch (38) that lies immediately below the button (48). A gasket (16) provides a seal between the housing (12) and the housing cover (14) to prevent water and/or dirt and other contaminants from infiltrating the interior of the pump (10).

A motor mount (18) provides a stable support for air (22) and water (28) motors. It may also include a divider plate separating the air (22) and water (28) motors. It is provided with an aperture for each of the motors to accommodate the output shafts of the air (22) and water (28) motors to extend through and engage air (26) and water (32) Impeller shafts. A battery mount (20) supports the battery (46). It may include a plurality of dips that secure the battery (46) in place. Further, it may have at least one aperture to allow for electrical connection of the battery (46) with the air (22) and water (28) motors.

The air motor receives electrical power from the battery (46) and is controlled by a controller (40). Operation of the air motor (22) is initiated or halted by actuation of the power switch (38). The air motor (22) is engaged with and rotationally drives the air impeller shaft (26) when the motor (22) is turned on. The water motor (28) also receives electrical power from the battery (46) and is also controlled by the controller (40). Operation of the water motor (28) is initiated or halted by actuation of the power switch (38) which may operate in conjunction with the controller (40).

The water motor (28) is engaged with and rotationally drives the water impeller shaft (32) when the motor is turned on.

In this embodiment, the air impeller (24) and water impeller (30) are, respectively, connected with and rotationally driven by the air impeller shaft (26) and water impeller shaft (32). In alternate embodiments, the air impeller (24) and water impeller (30) may be disconnected from the air impeller shaft (26) and water impeller shaft (32), and the methods of connection and construction disclosed herein should not be considered limiting. Each impeller shaft (26, 32) is provided with a lipseal (36) at the point where it exits the housing (12) and is supported by a ball bearing (34). Impellers may take a variety of forms including, for example, a shrouded radial blade, open radial blade, open paddle wheel, backward inclined blade, backward curved blade, airfoil blade, forward curved multi-vane blade, backward curved radial blade, axial impeller, propeller, or similar element. The air impeller (24) is engaged when the pump (10) is employed in an air environment rather than water, while the water impeller (30) is engaged when the pump (10) operates in water. Both impellers (24,30) may be engaged simultaneously to provide multi-medium pumping, a feature that allows said pump to "self-prime" in numerous environments. The impellers (24, 30) function to draw air or water into and through where the pump (10) would be housed for filtering before being exhausted.

The power switch (38) controls the initiation and cessation of operation of the pump (10). It is electrically connected with the battery (46) and the controller (40). The term "switch" is used herein for convenience only. The mechanism may take the form of a push button, slide switch, wireless switching, or other form. In a preferred embodiment, the actual power switch (38) is a push button switch that is contained within the housing (12) immediately underneath the housing cover (14). A button (48) in the housing cover (14) can engage the power switch (38) to actuate it. When a user depresses the button (48), the button (48) is lowered to engage the actual power switch (38).

The battery (46) is preferably rechargeable. The battery (46) is connected with the DC connector (42), which is accessible through the housing cover (14) port, to enable charging of the battery (46). In some embodiments, a battery status indicator may be provided. The status indicator may be visual, for example, an LED lamp or small screen, in order to indicate the charge level of the battery, including when the battery requires recharging. The status indicator, through the use of wireless signals, may also be provided through a smart phone or other IoT capable device. The battery (46) is electrically connected with both the air (22) and water (28) motors and with the controller (40) to provide power to each of those elements. In alternate embodiments, batteries may be substituted with any alternate power source as desired, like traditional corded power. The use of batteries should not be considered limiting to the scope of the invention, as other power options are also envisioned.

The controller (40) is responsible for controlling operation of the air (22) and water (28) motors and, more particularly, the selective supply of power from the battery (46) to the motors (22, 28). The controller (40)—in some embodiments, in cooperation with one or more sensors—determines whether the pump (10) is operating in an air or water environment. In response to an initiation signal from the power switch (38) and the sensors, the controller (40) directs power to the air (22) and/or water (28) motor/s so that the appropriate impeller shaft and impeller are placed into operation. In an alternate embodiment that is manually controlled, the controller (40) may be replaced with a selector switch that a user manually moves among, for example, an "air setting", a "water setting", a "multi-setting", and/or an "auto setting" to select the appropriate motor/impeller combination for the current environment of use.

FIGS. 5-9B illustrate another embodiment in which a pump (100) incorporates a single motor and two impellers and employs a clutch for selective mating of the motor with one of the impellers. In addition to selection of the appropriate impeller, the clutch may adjust the torque and speed of the motor output as appropriate for the selected impeller and medium.

The single motor (122) is used to drive both the air (124) and water (130) impellers. The selective connection between the output shaft of the motor (122) and a water impeller gear (156) and an air impeller gear (158) may include a motor gear (154) that is connected with and driven by the output shaft of the motor (122). The motor gear (154) may be selectively engaged with either the water impeller gear (156) or the air impeller gear (158)—through a clutch gear (160)—when the motor (122) is turned on. The water impeller gear (156) and air impeller gear (158) may each be configured with diameters and gear tooth configurations that adjust power transmission parameters to more effectively configure the power output for each of the impellers.

The water impeller gear (156) is fixed to and drives a water impeller shaft (132). It is driven by the clutch gear (160) when the actuator (150) moves an actuator arm (152) attached with the clutch gear (160) such that the clutch gear (160) is brought into meshed engagement with the water impeller gear (156). The air impeller gear (158) is fixed to and drives the air impeller shaft (126). It is driven by the clutch gear (160) when the actuator (150) moves the actuator arm (152) attached with the clutch gear (160) such that the clutch gear (160) is brought into meshed engagement with the air impeller gear (158).

The clutch gear (160) is driven by the motor gear (154). It is mounted on the actuator arm (152) and is moved between two positions—in engagement with (a) the motor gear (154) and the water impeller gear (156) or (b) the motor gear (154) and the air impeller gear (158). In a preferred embodiment, the actuator (150) may take the form of a solenoid or similar electromechanical device.

In alternate versions of this type of embodiment, two separate clutch gears may be provided. A first clutch gear may selectively engage/disengage the air impeller gear (158), and a second clutch gear may selectively engage/disengage the water impeller gear (156). Each of the two clutch gears may be provided with its own actuator to move the respective clutch gear into engagement/disengagement with its associated impeller gear (156 or 158) and the motor gear (154) depending on the detected fluid. This version would also allow for both impeller gears (156, 158) to be engaged and driven simultaneously if desired, for example, when a combination of fluids is detected, by activating both actuators at the same time.

Alternately, the actuators could be eliminated from the embodiment in favor of a clutch system, such as one of the systems described elsewhere herein or a combination thereof, that selectively engages/disengages one or both of the impeller gears (156, 158) with the motor gear (154). In one version, the water impeller gear (156) may be configured to directly engage the motor gear (154) while a clutch mechanism selectively engages/disengages the air impeller gear (158) with the motor gear (154). In this example, the water impeller gear (156) would remain engaged with the motor gear (154) on a full-time basis while the air impeller gear (158) is selectively engaged, together with the water impeller gear (156), only when air is detected, again resulting in both impeller gears (156, 158) being simultaneously driven. In a variation, the water impeller gear (156) may also be provided with a clutch mechanism so that it is selectively engaged with the motor gear (154) only when water is detected, which would result in reduced energy consumption.

Figure 9:
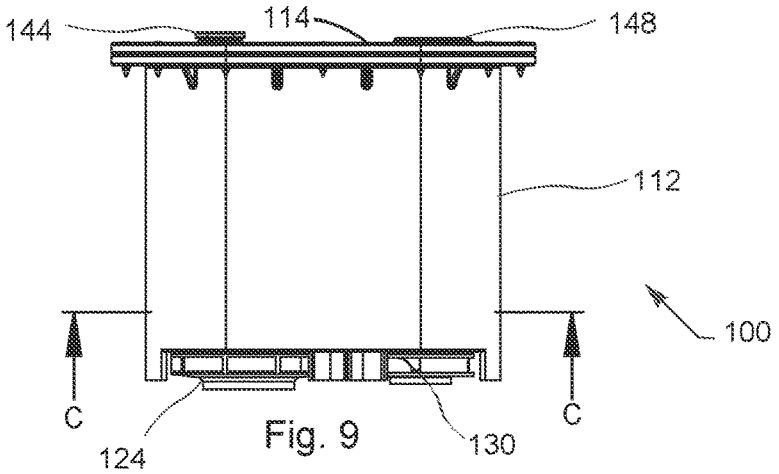
FIG. 9 is a front view of the fluid vacuum pump of FIG. 5.
Figure 9A:
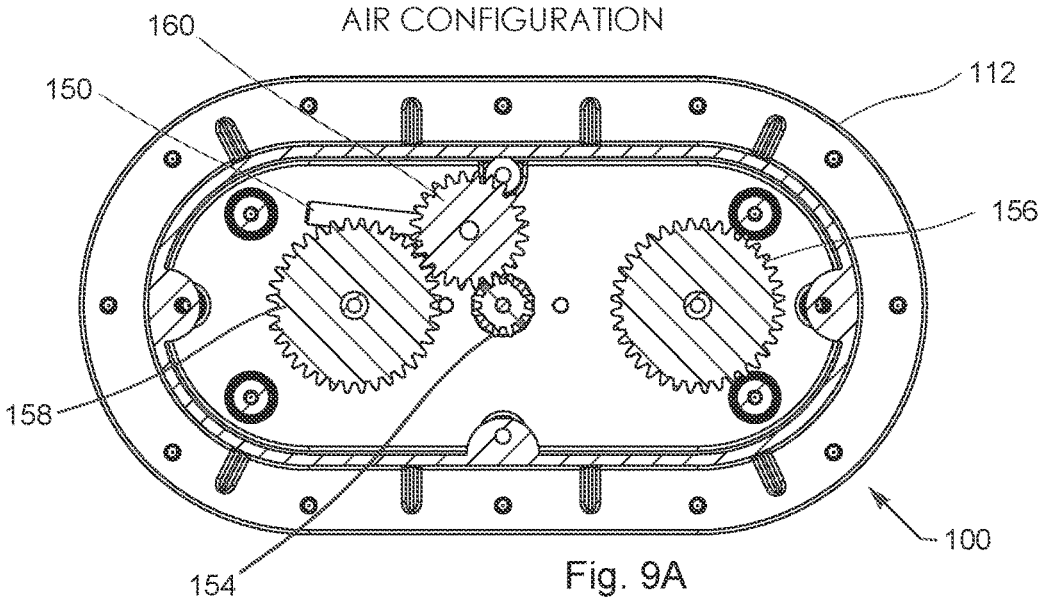
FIG. 9A is a first section view of the fluid vacuum pump taken along the section line C-C of FIG. 9 showing the pump in an air configuration.
Figure 9B:
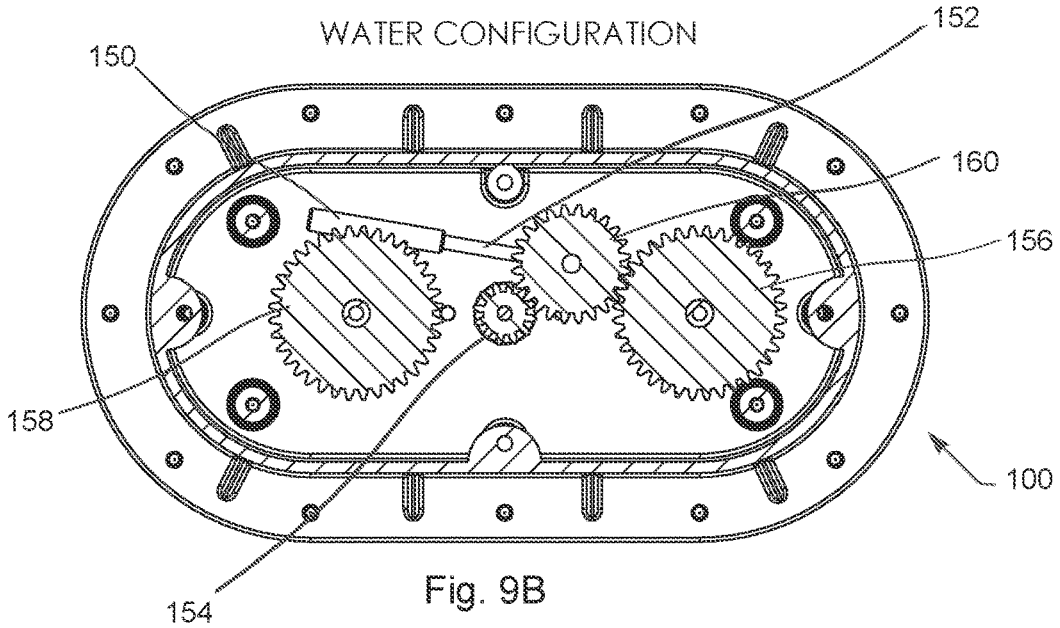
FIG. 9B is a second section view of the fluid vacuum pump taken along the section line C-C of FIG. 9 showing the pump in a water configuration.
Figure 10:
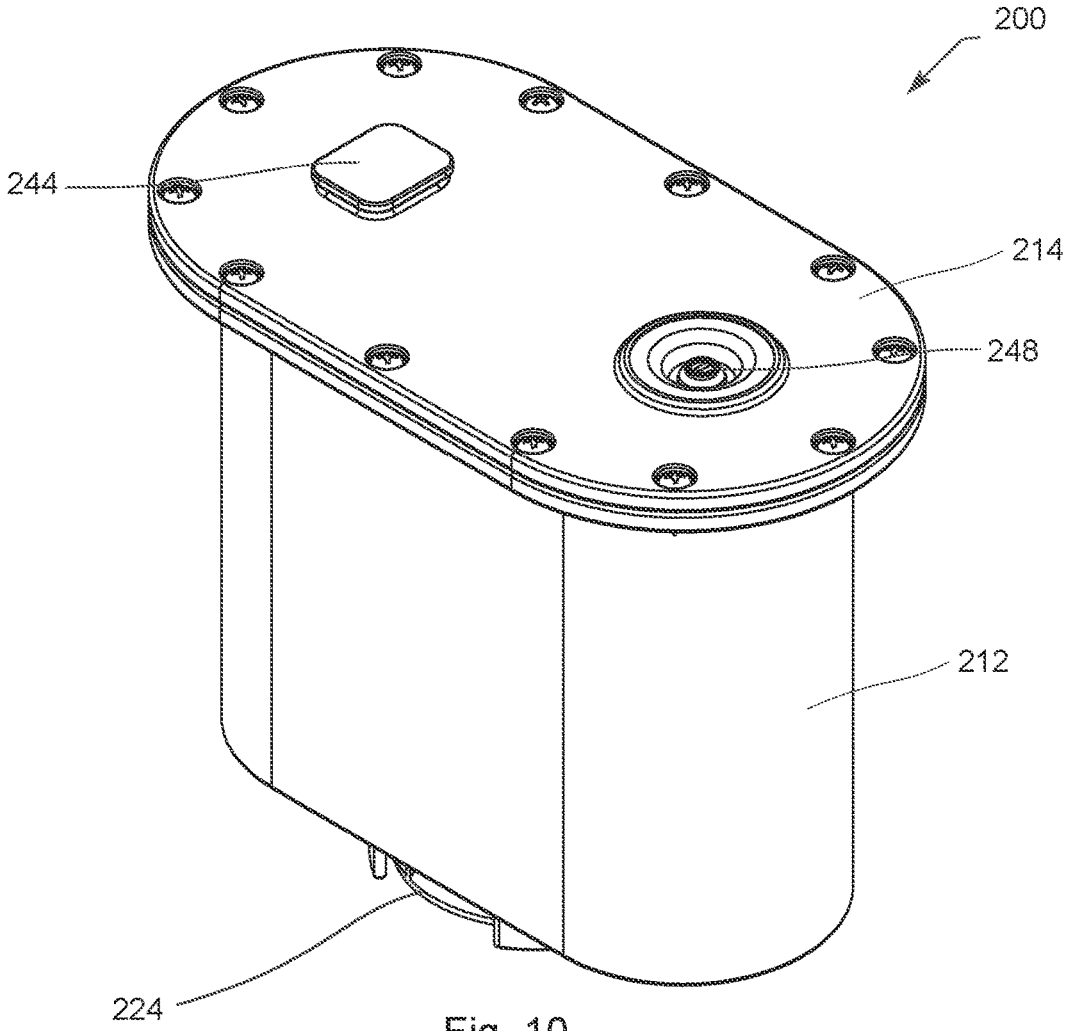
FIG. 10 is a perspective view of a fluid vacuum pump incorporating two motors and one impeller according to another embodiment of the present disclosure.
Figure 11:
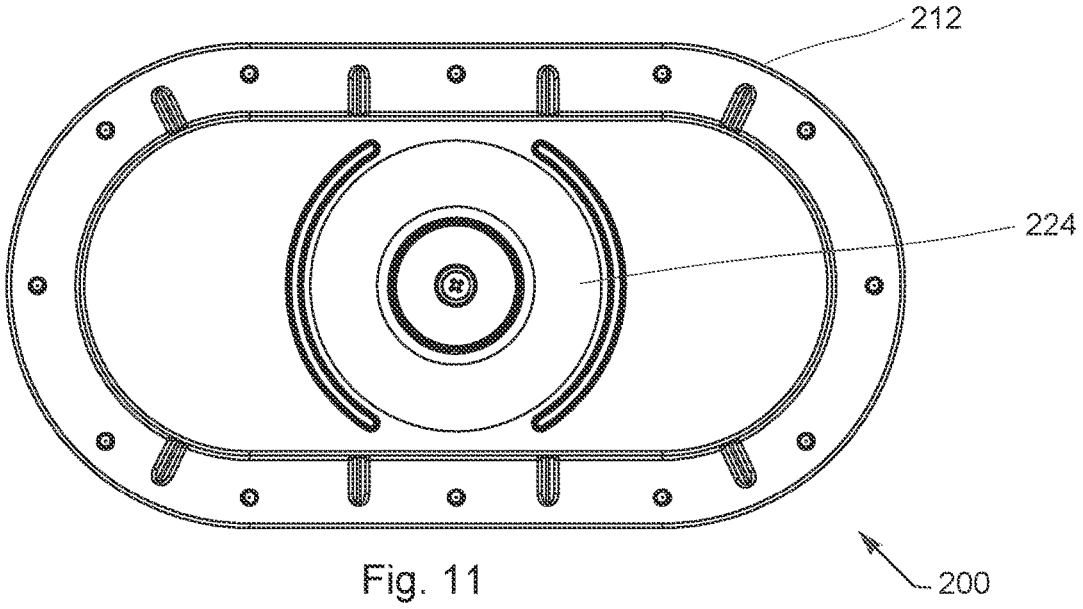
FIG. 11 is a bottom view of the fluid vacuum pump of FIG. 10.
Figure 12:
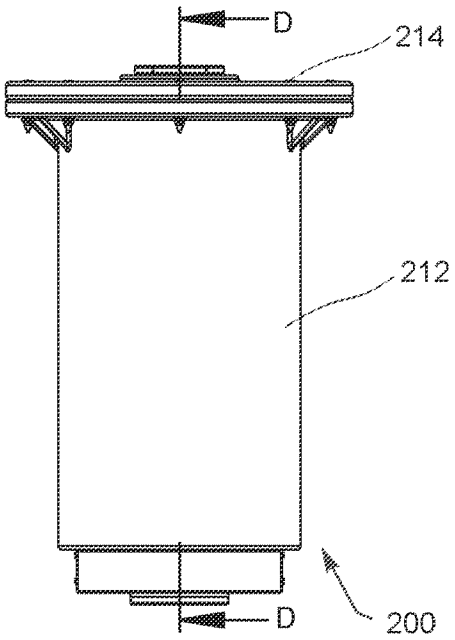
FIG. 12 is a side view of the fluid vacuum pump of FIG. 10.
Figure 12A:
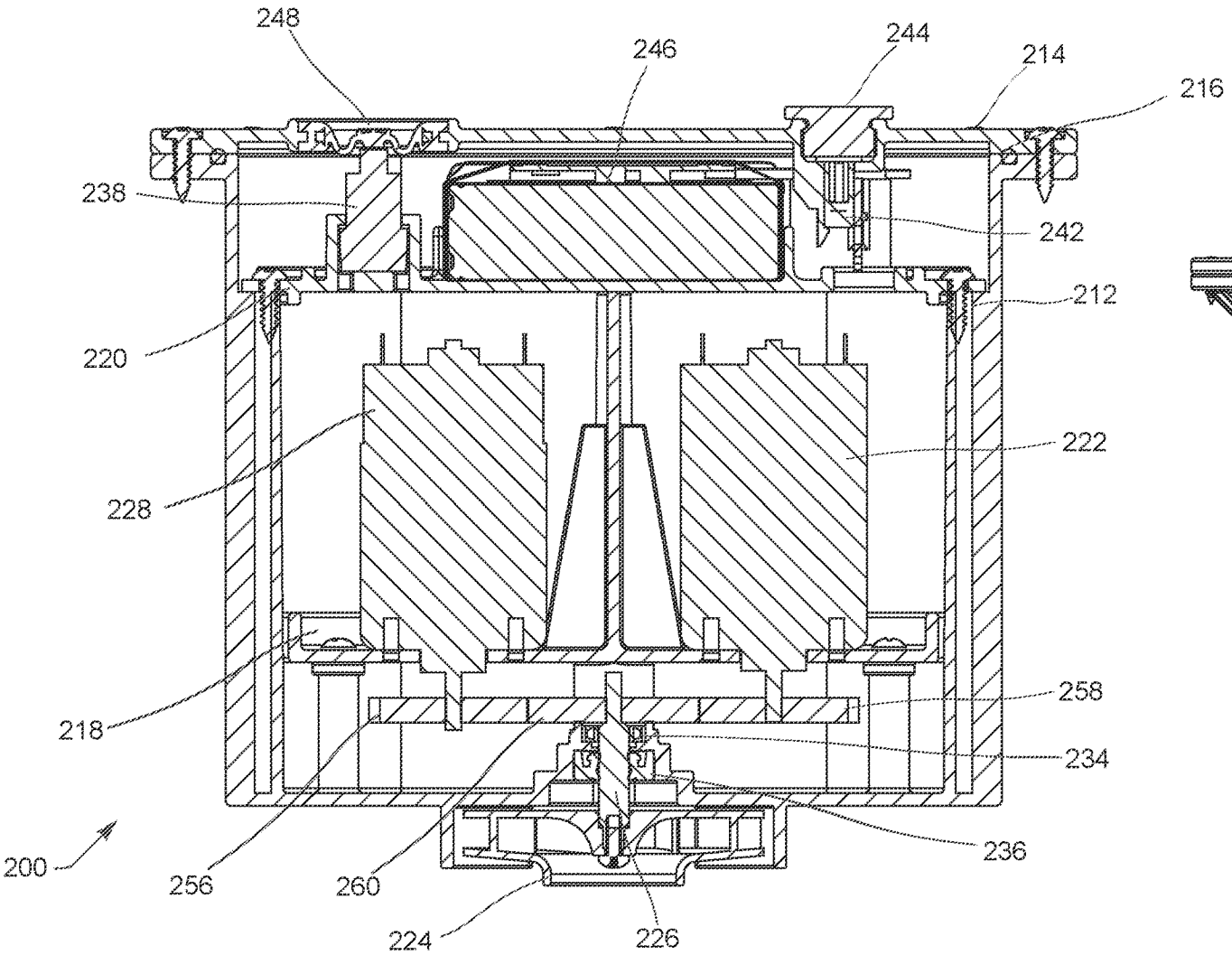
FIG. 12A is a cross-section view of the fluid vacuum pump taken along the section line D-D of FIG. 12.
Figure 13:
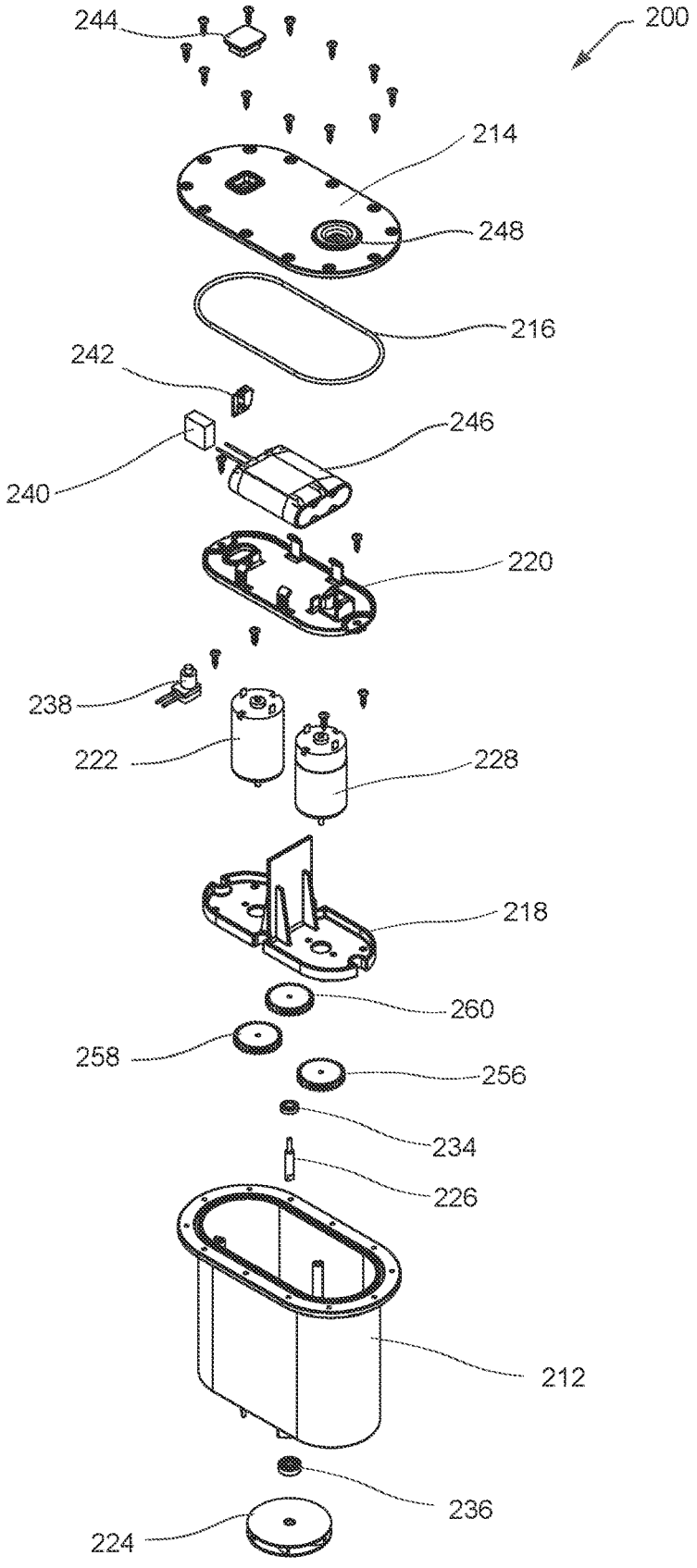
FIG. 13 is an exploded perspective view of the fluid vacuum pump of FIG. 10.
Figure 14:
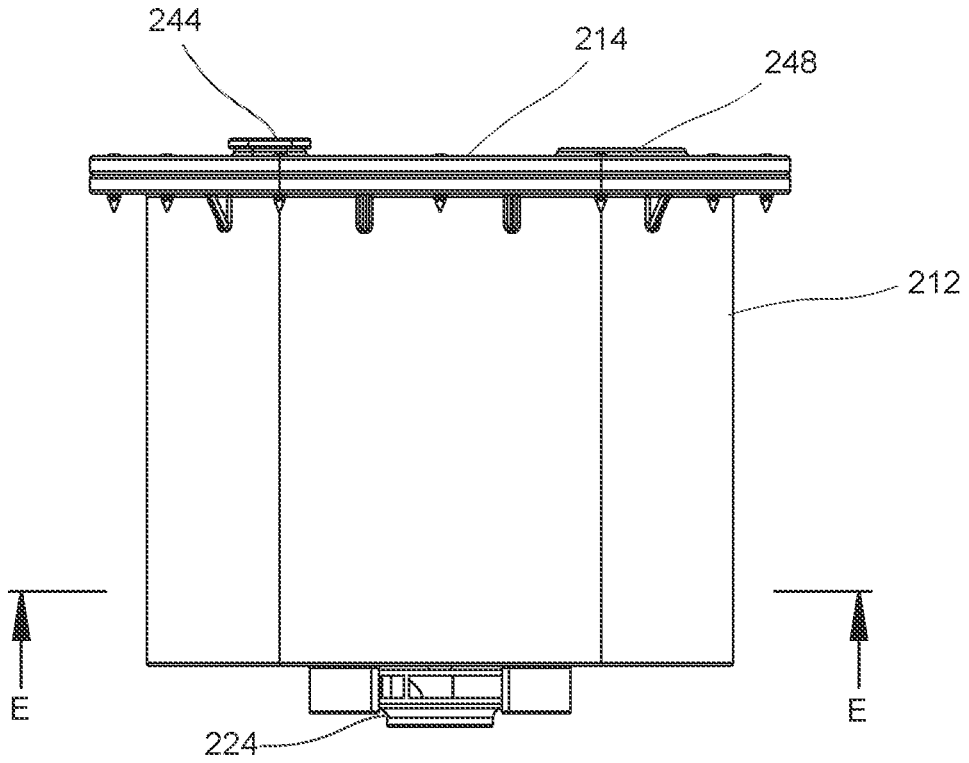
FIG. 14 is a front view of the fluid vacuum pump of FIG. 10.
Figure 14A:
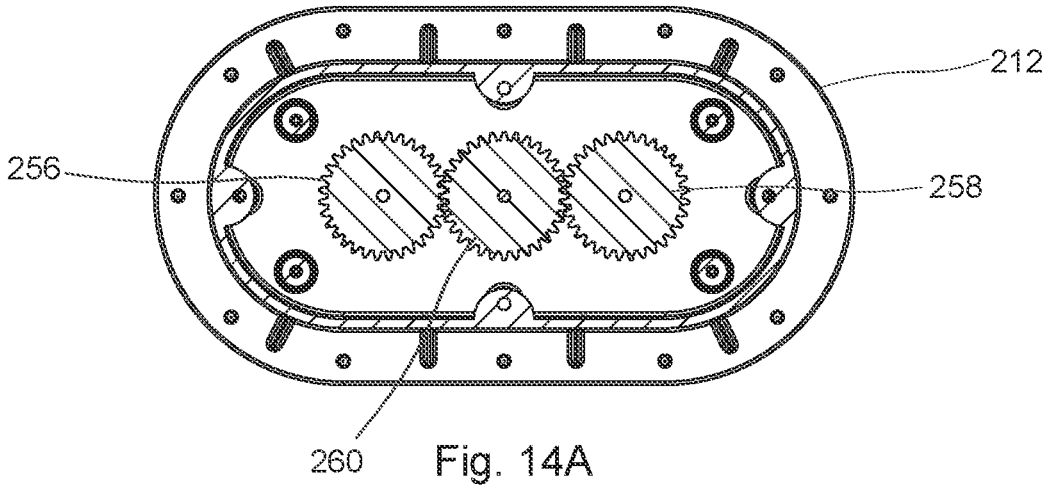
FIG. 14A is a section view of the fluid vacuum pump taken along the section line E-E of FIG. 14.
Figure 15:
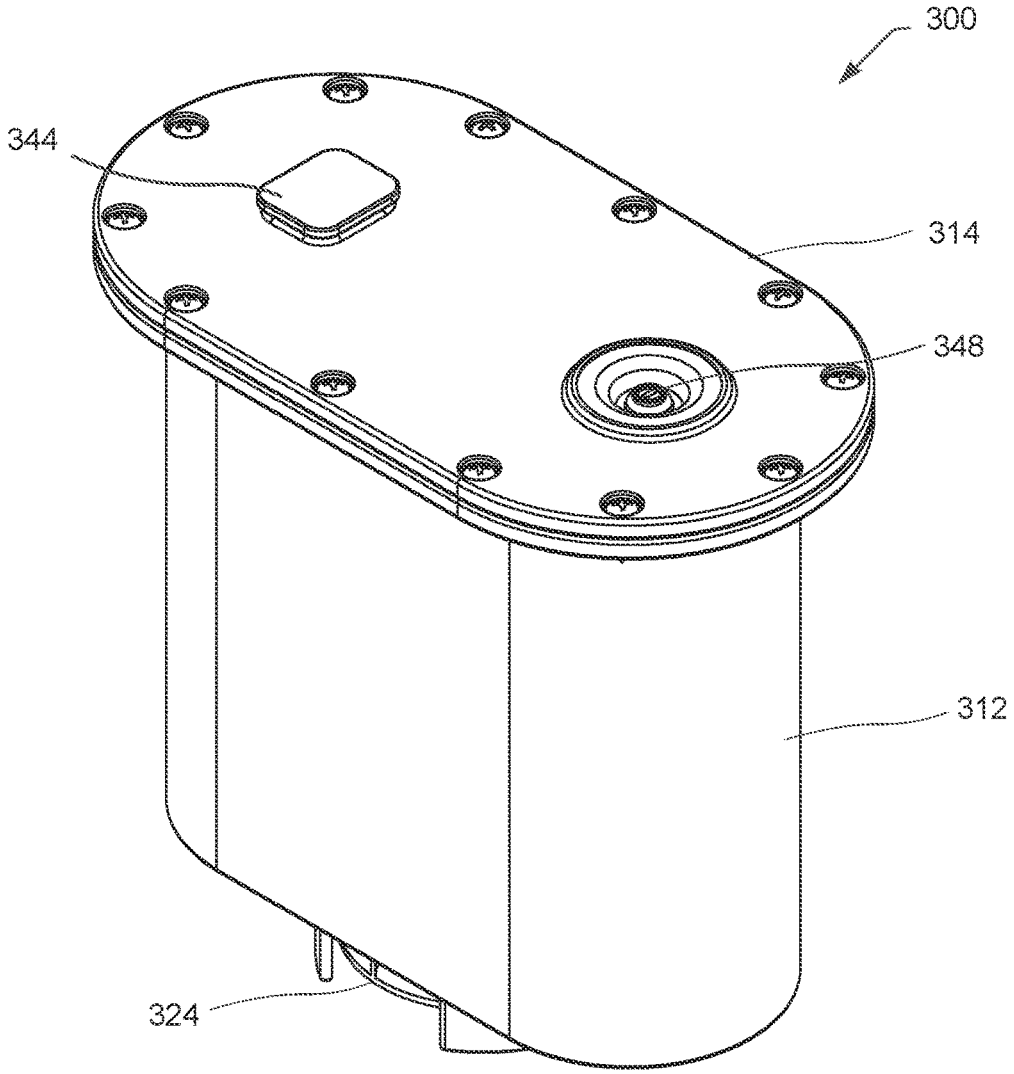
FIG. 15 is a perspective view of a fluid vacuum pump incorporating two motors and one impeller according to another embodiment of the present disclosure.
Figure 16:
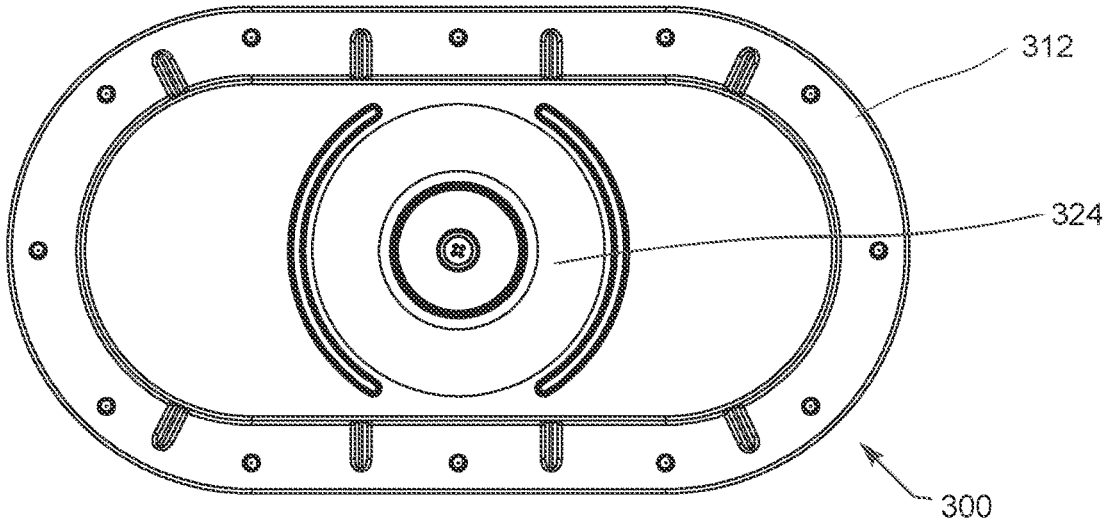
FIG. 16 is a bottom view of the fluid vacuum pump of FIG. 15.
Figure 17:
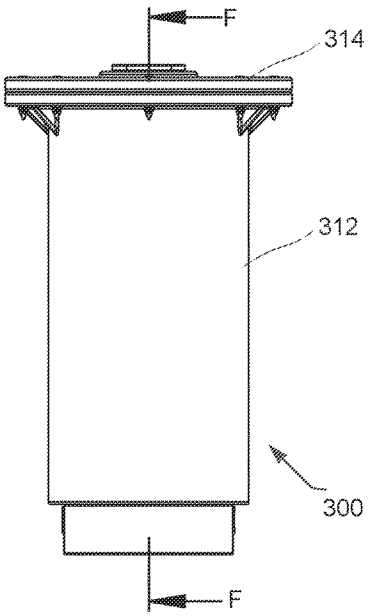
FIG. 17 is a side view of the fluid vacuum pump of FIG. 15.
Figure 17A:
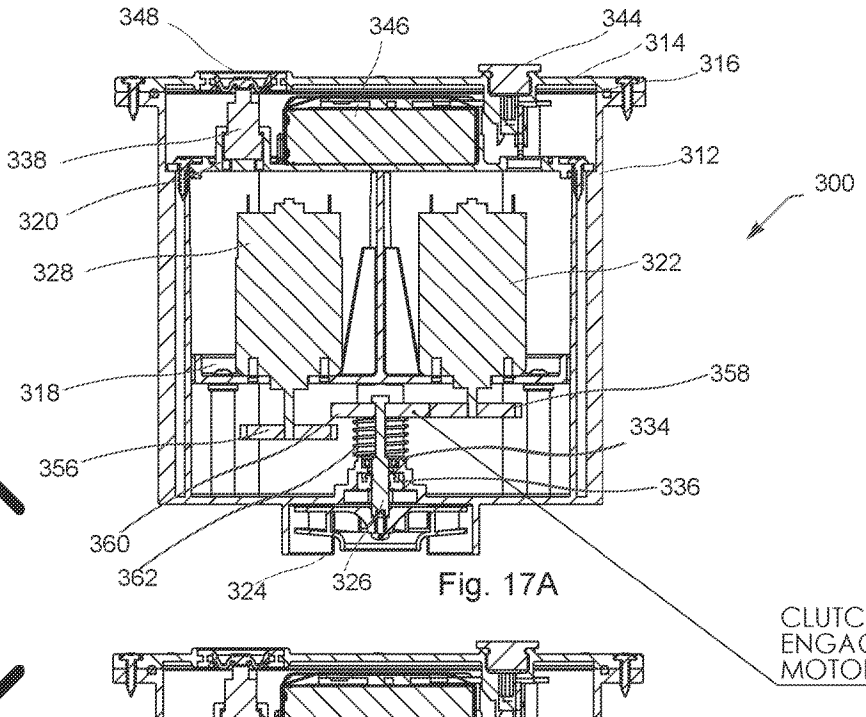
FIG. 17A is a first cross-section of the fluid vacuum pump taken along the section line F-F of FIG. 17 showing the pump in an air configuration.
Figure 17B:
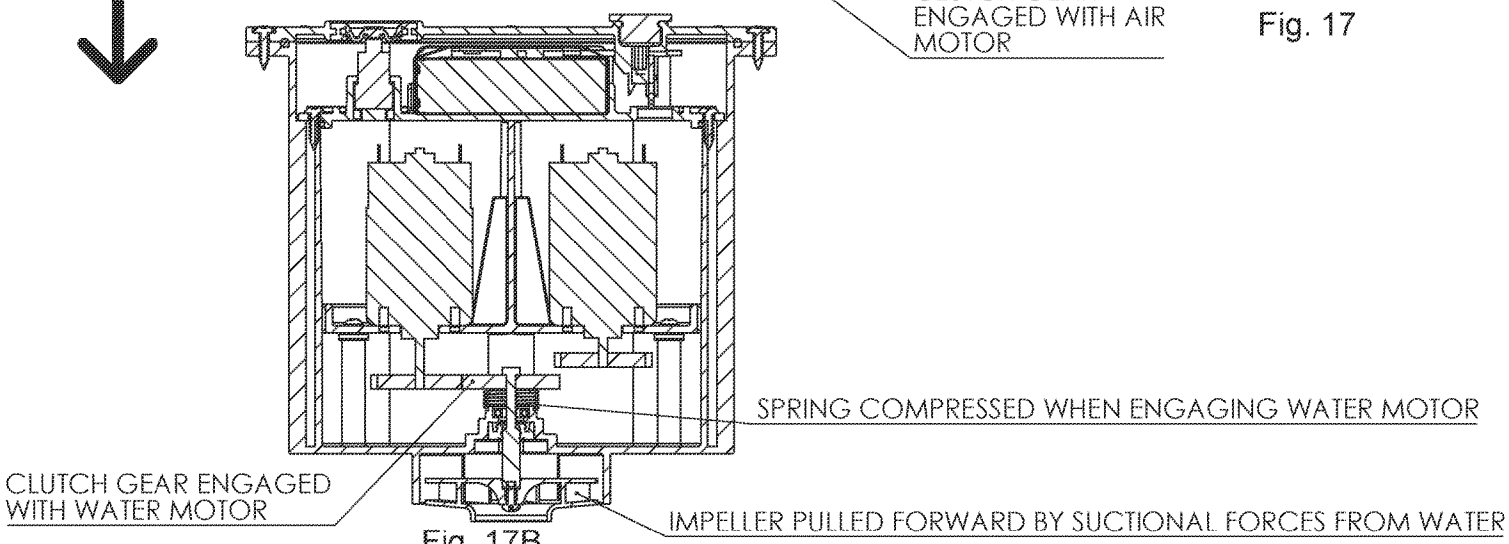
FIG. 17B is a second cross-section of the fluid vacuum pump taken along the section line F-F of FIG. 17 showing the pump in a water configuration.
Figure 18:
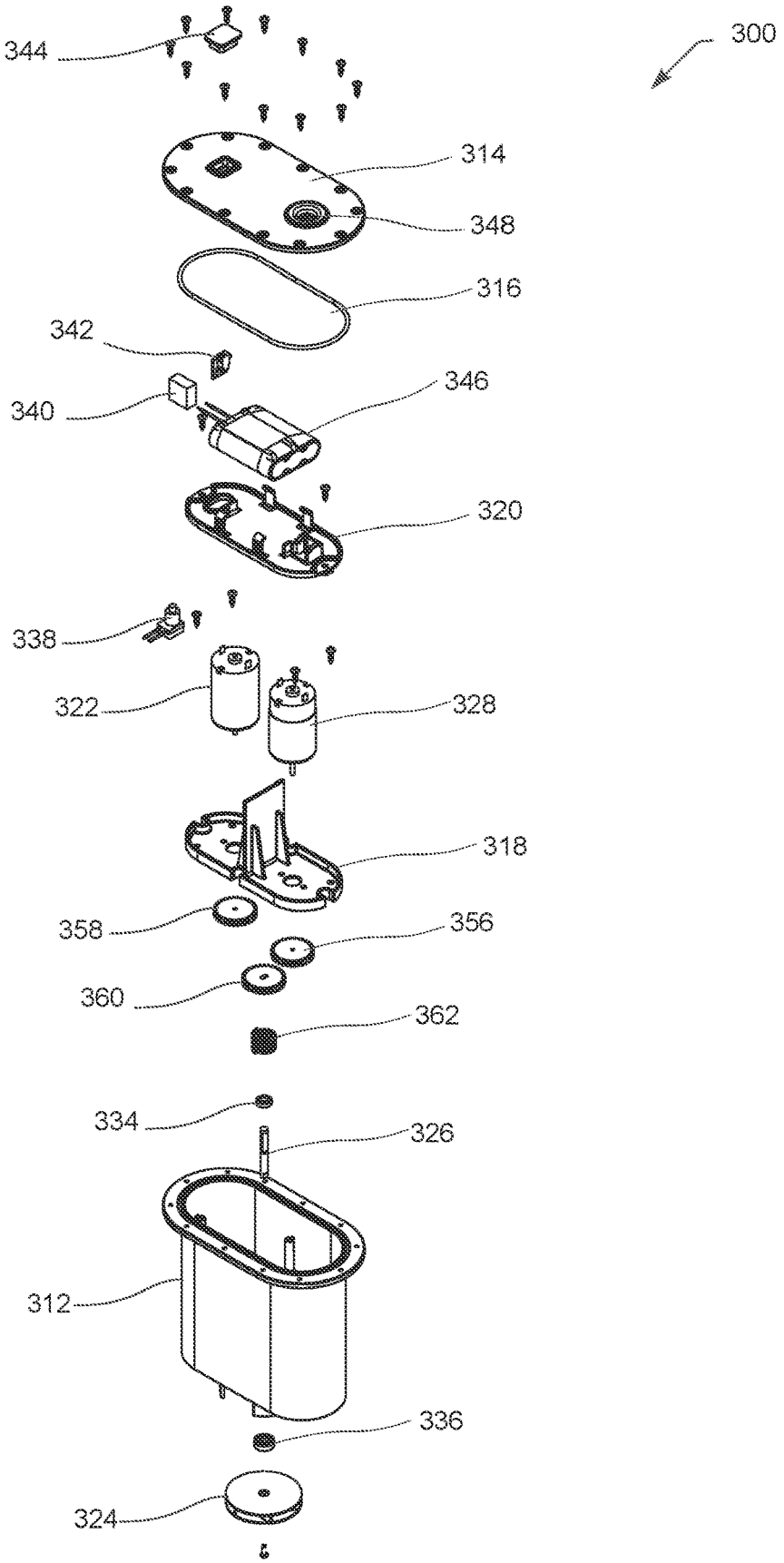
FIG. 18 is an exploded perspective view of the fluid vacuum pump of FIG. 15.
Figure 19:
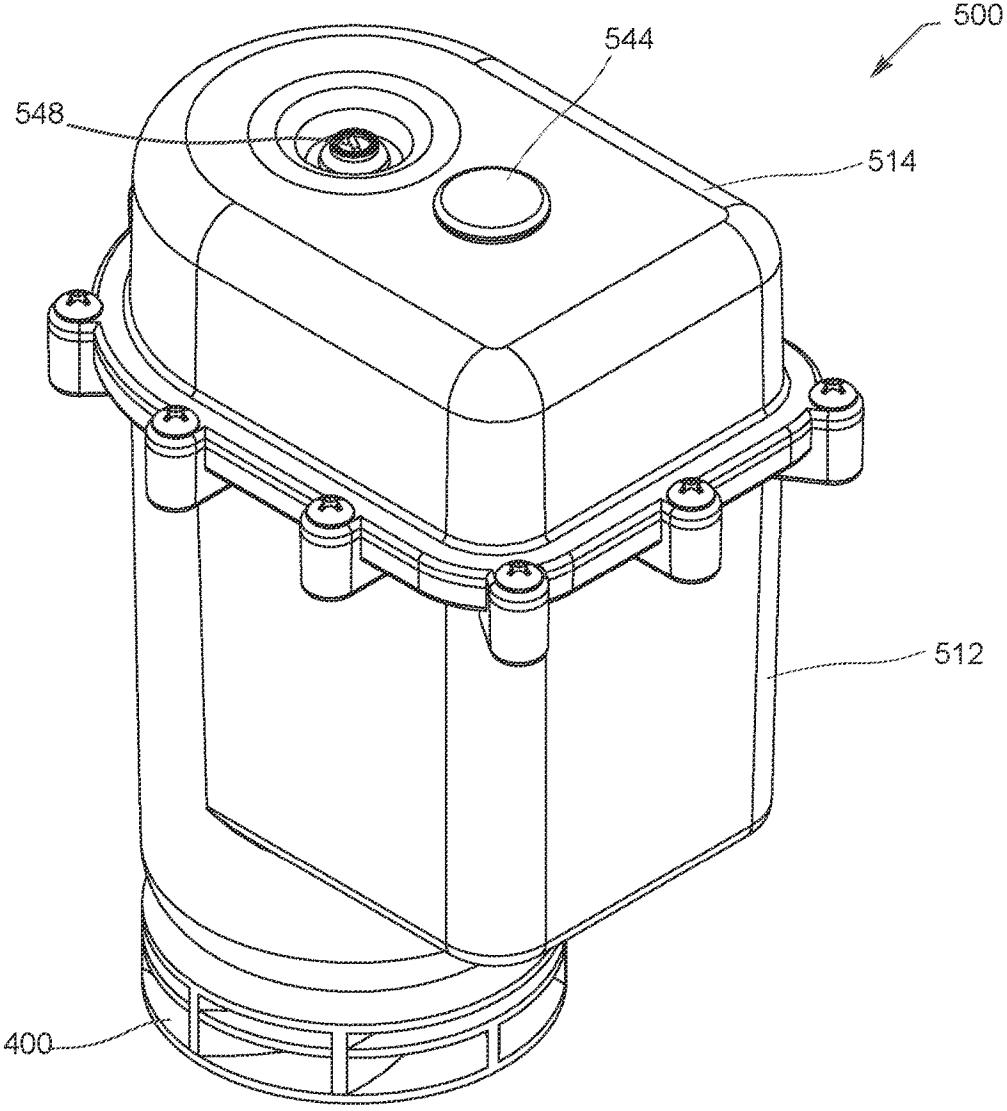
FIG. 19 is a perspective view of a fluid vacuum pump incorporating one motor and a variable configuration impeller according to another embodiment of the present disclosure.
Figure 20:
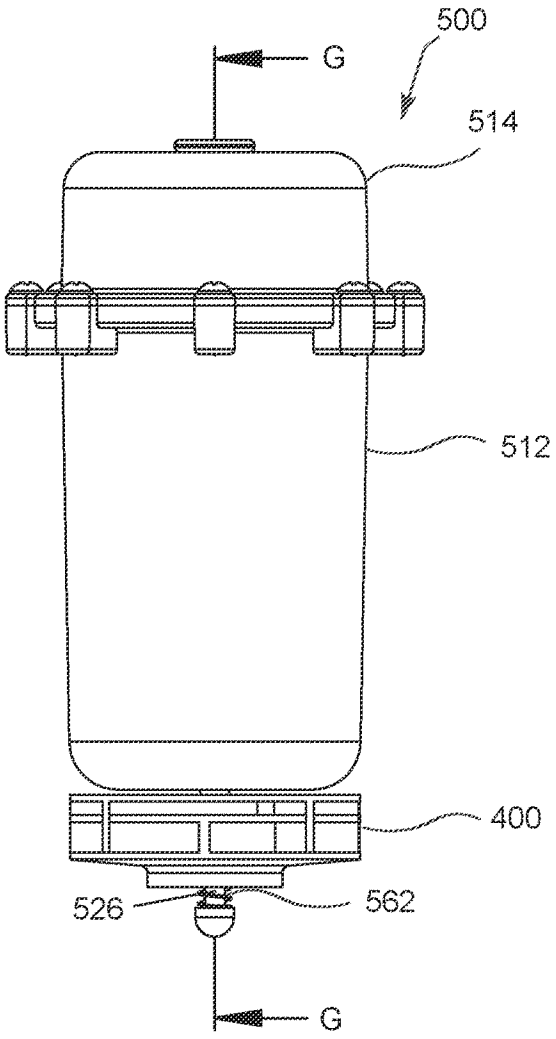
FIG. 20 is a side view of the fluid vacuum pump of FIG. 19.
Figure 20A:
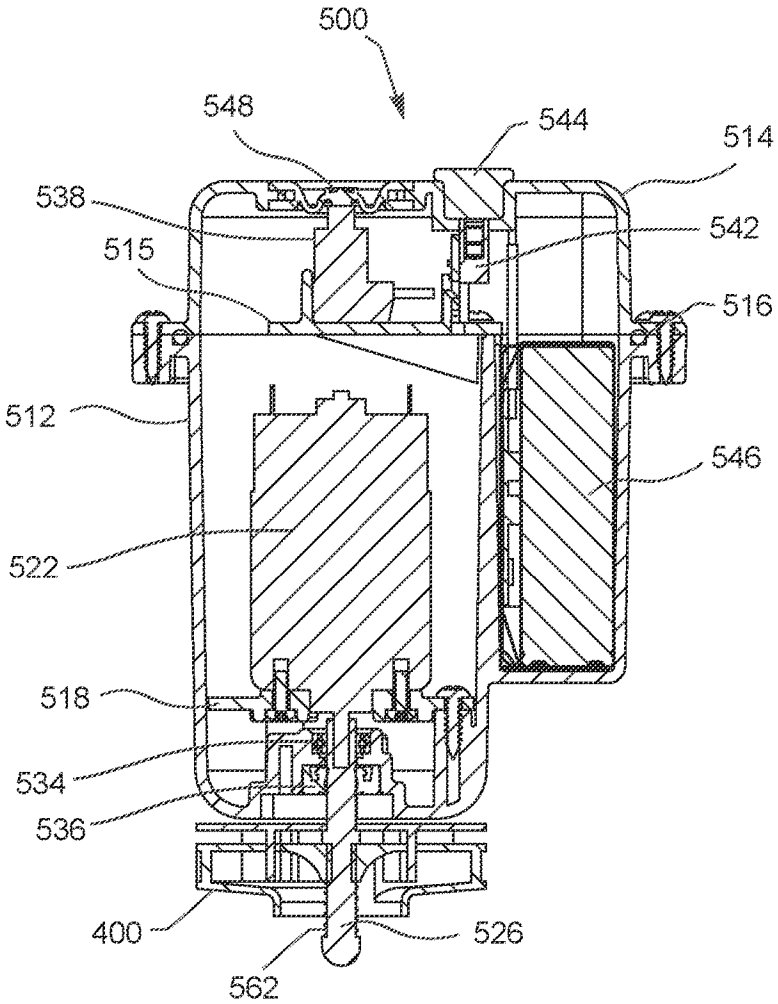
FIG. 20A is a cross-section of the fluid vacuum pump taken along the section line G-G of FIG. 20.
Figure 21:
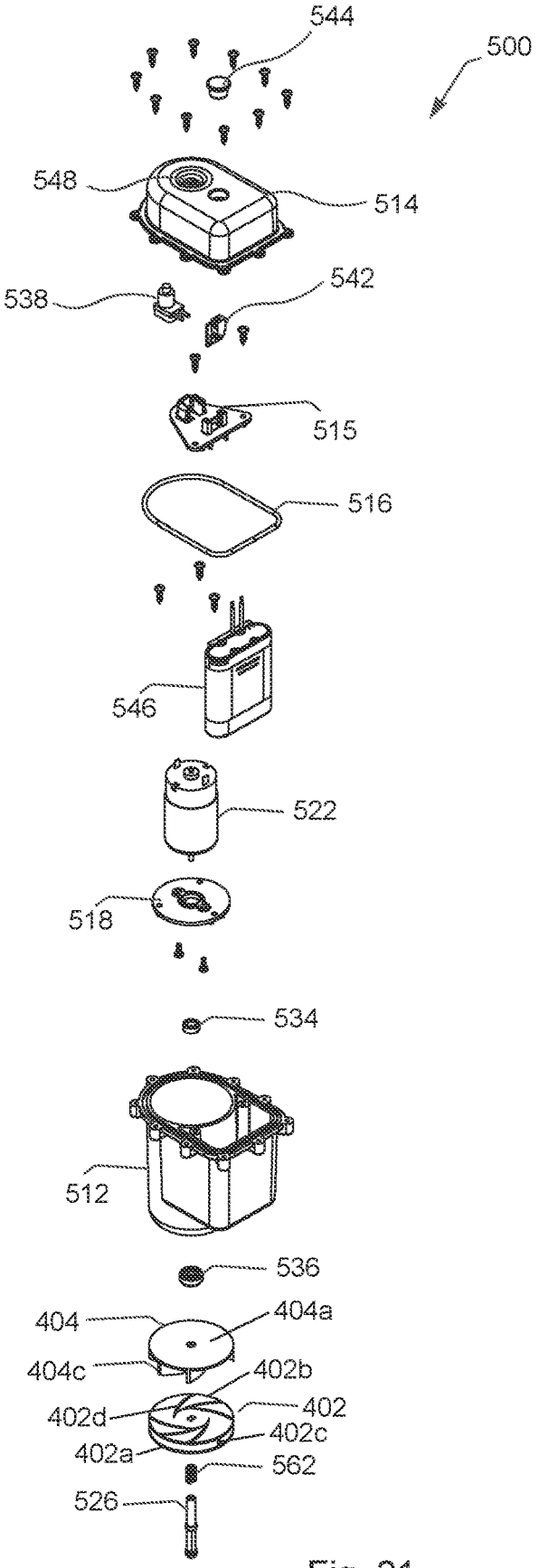
FIG. 21 is an exploded perspective view of the fluid vacuum pump of FIG. 19.

As in the first embodiment, a controller (140) is responsible for controlling operation of the motor (122) and the actuator (150). The controller (140)—in some embodiments, in cooperation with one or more sensors—determines whether the pump (100) is operating in an air or water environment. In response to an initiation signal from the power switch (138) and the sensors, the controller (140) sends a signal to the actuator (150) to move the actuator arm (152) such that the clutch gear (160) is moved into engagement with either the water impeller gear (156) or air impeller gear (158). The controller (140) then directs power to the motor (122) to drive the selected gear, shaft and impeller combination. The two positions of the clutch gear (160) are illustrated in FIGS. 9A-B.

In an alternate embodiment that is manually controlled, the controller (140) and actuator (150) may be replaced with a selector switch that a user manually moves among, for example, an "air setting", a "water setting", a "multi-setting"—which may involve engagement of both impeller gears simultaneously, as described in the above exemplary embodiments, when a combination of fluids is encountered, and/or an "auto setting" to allow for automatic selection of the appropriate gear/impeller combination for the current environment of use.

FIGS. 10-14A illustrate a two motor, single impeller pump (200). In this pump (200), a linking gear (260) is utilized to transmit rotation from the motors (222, 228) to the impeller (224). In this pump (200), an output shaft of an air motor (222) is engaged with and rotationally drives an air impeller gear (258) when the air motor (222) is activated. A water motor (228) is engaged with and rotationally drives a water impeller gear (256) when the motor (228) is activated.

A linking gear (260) is connected to and drives an impeller shaft (226). The impeller shaft (226) is engaged with and driven by, selectively, the water impeller gear (256) or air impeller gear (258) depending on which motor (222, 228) is in operation. In the illustrated embodiment, the linking gear (260) is permanently engaged with both the water impeller gear (256) and air impeller gear (258), eliminating the need for a clutch mechanism to move the linking gear (260) from engagement with one gear to the other. In such embodiments, as the linking gear (260) is being driven by the actively operating motor, it is also driving the gear associated with the inactive motor. In some embodiments, the motors may be used to recapture energy through this driven rotation. In alternate embodiments a differential may be used to combine both motor outputs, in which case the air motor (222) and water motor (228) may be identical in design. In other alternate embodiments a movable clutch gear may be used for selective engagement of each motor similar to the clutch gear (160) of pump (100).

Again, the controller (240) is responsible for determining the medium in which the pump (200) is operating and activating the appropriate motor and gear combination. As in the other embodiments, a manual selector switch may alternately be used.

FIGS. 15-18 illustrate another embodiment of a two motor, single impeller pump (300). Again, the pump (300) incorporates an air motor (322) and water motor (328) that are connected with an impeller (324) by a clutch mechanism. This embodiment illustrates the availability of multiple clutch mechanisms to move a clutch gear (360) between positions in which it selectively engages an output gear of either of the two motors to transmit power from that gear to an impeller shaft (326). More broadly, each of the clutch systems described in the present disclosure may be incorporated into any of the various embodiments described herein.

More particularly, the air motor (322) is engaged with and rotationally drives an air impeller gear (358). Notably, the air motor (322) is provided with an output shaft that is shorter than the output shaft of the water motor (328). This arrangement places the air impeller gear (358) in a different plane than a water impeller gear (356) that is connected with and driven by the water motor (328), preferably at a greater distance from the impeller (324), thereby allowing the air impeller gear (358) to be engaged by a clutch gear (360) independently of the water impeller gear (356).

Advantageously, the water motor (328) is provided with an output shaft that is somewhat longer than the output shaft of the air motor (322). This arrangement places the water impeller gear (356) in a plane that is preferably closer to the impeller (324) than the air impeller gear (358), again allowing the water impeller gear (356) to be engaged by the clutch gear (360) independently of the air impeller gear (358). The length of the shaft should not be considered a limiting factor. In alternate embodiments, the length of the shaft remains the same and the positioning of the gears on the shafts are different or motors are placed at different heights, etc. There are many ways to accomplish this same feat.

Figure 37:
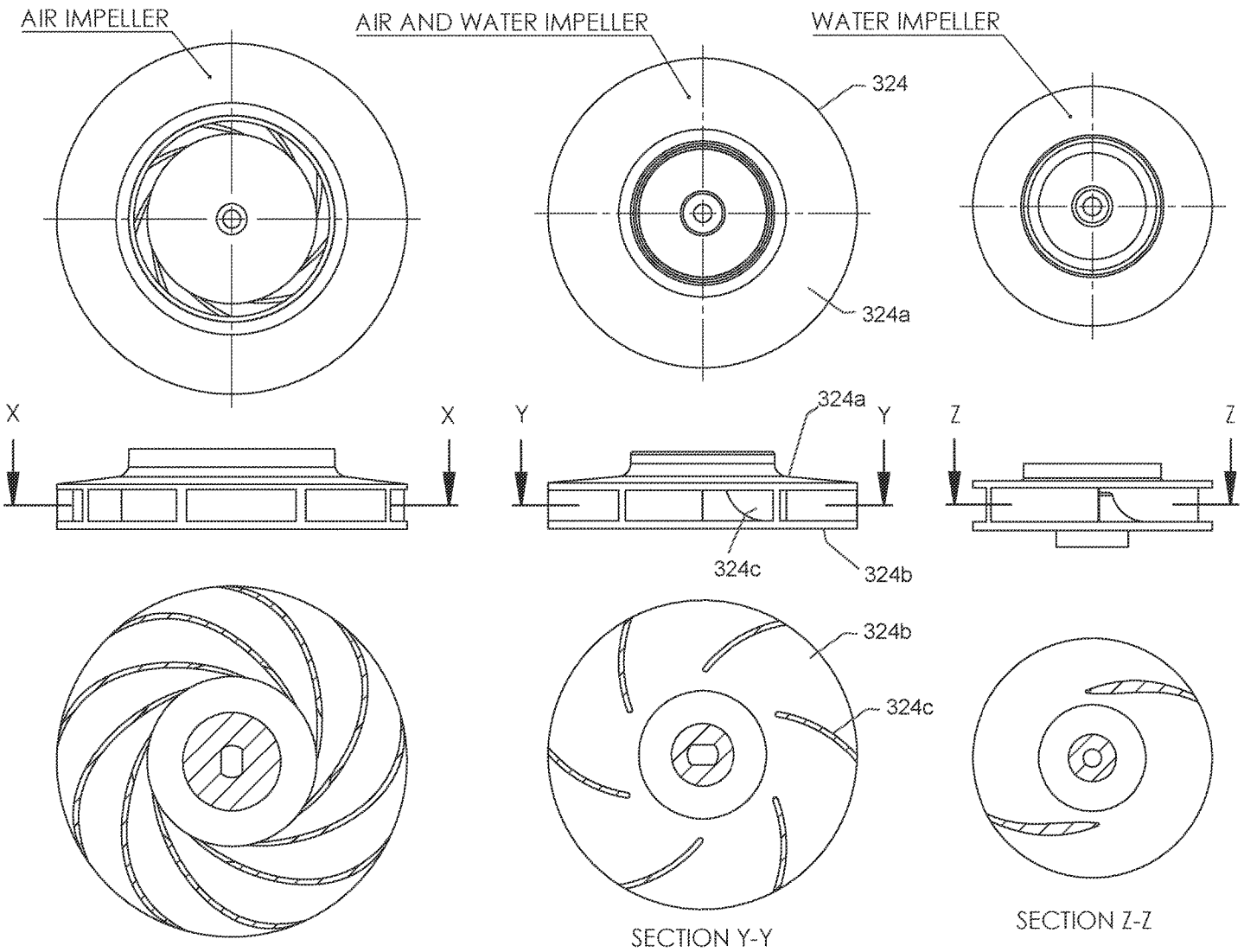
FIG. 37 presents top, side, and section views of embodiments of an air impeller, a fluid impeller, and a water impeller suitable for use in various embodiments of the present disclosure.
Figure 38:
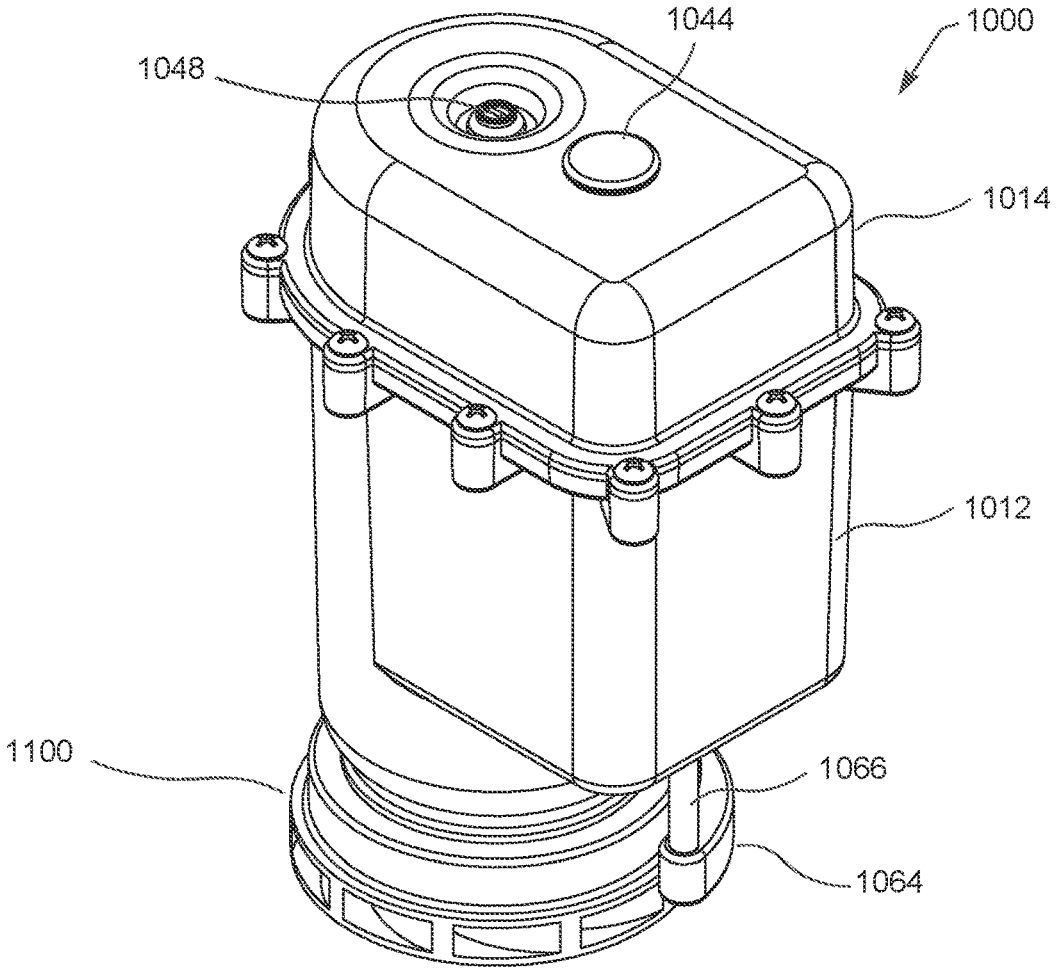
FIG. 38 is a perspective view of a fluid vacuum pump incorporating one motor and a variable configuration impeller according to another embodiment of the present disclosure.
Figure 39:
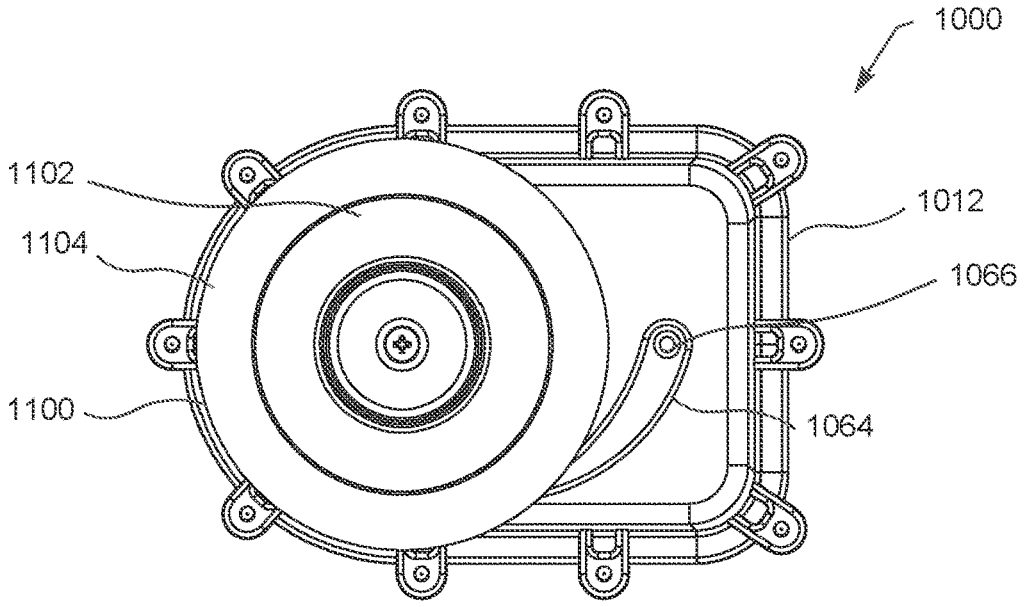
FIG. 39 is a bottom view of the fluid vacuum pump of FIG. 38.
Figure 40:
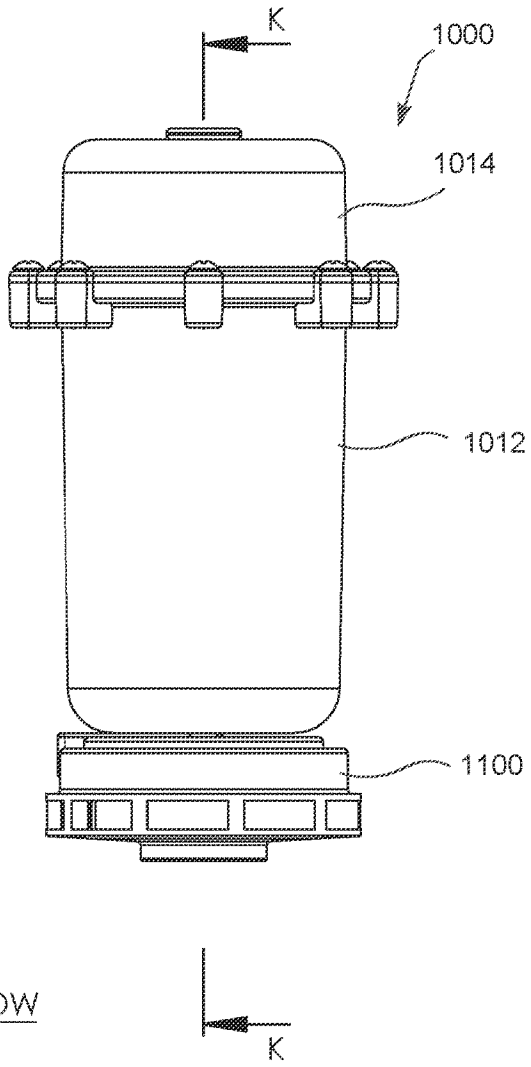
FIG. 40 is a side view of the fluid vacuum pump of FIG. 38.
Figure 40A:
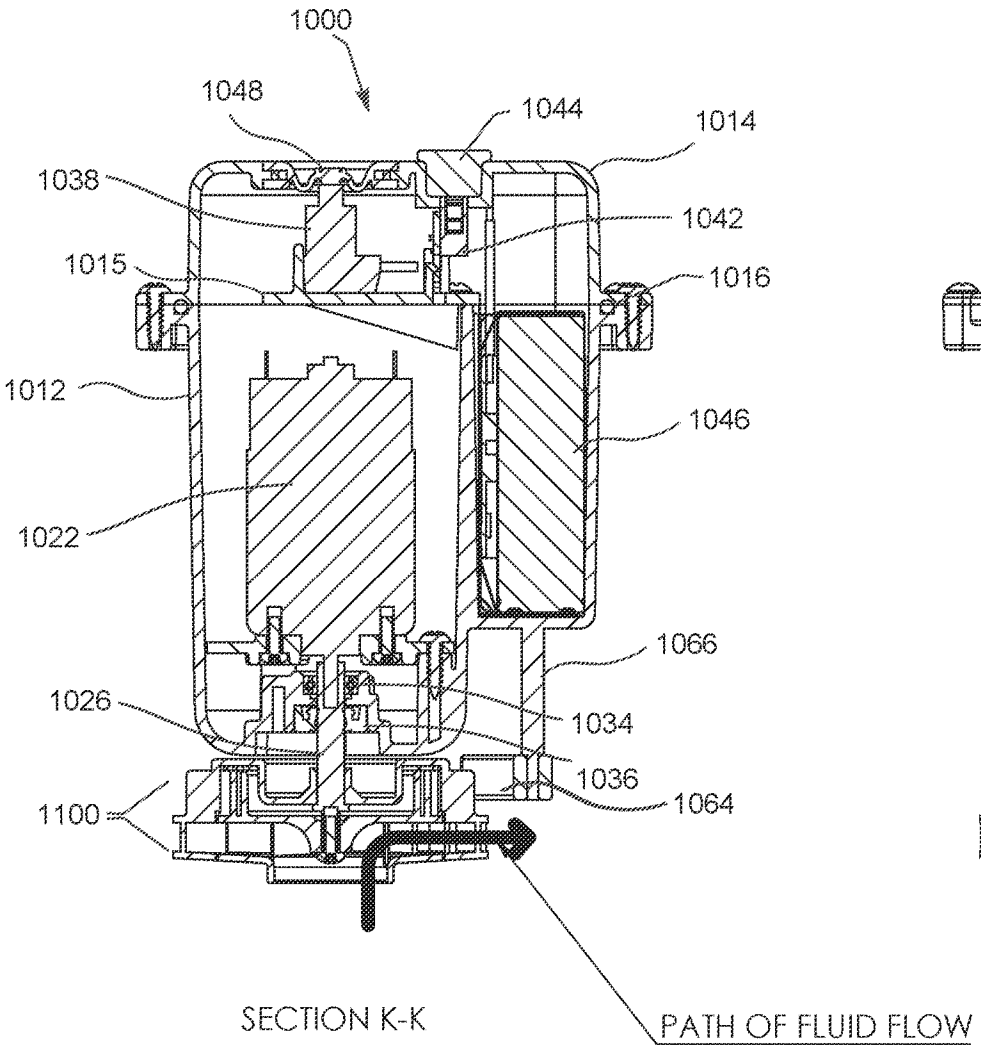
FIG. 40A is a cross-section of the fluid vacuum pump taken along the section line K-K of FIG. 40.
Figure 41:
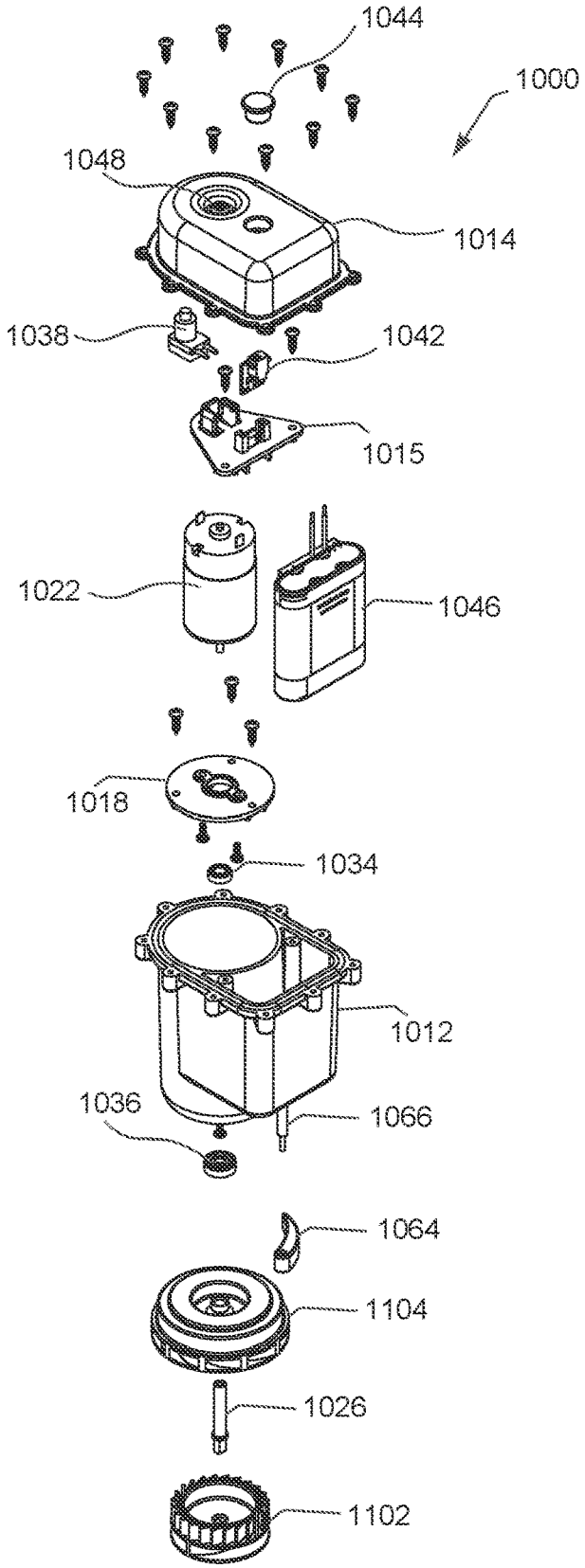
FIG. 41 is an exploded perspective view of the fluid vacuum pump of FIG. 38.
Figure 42A:
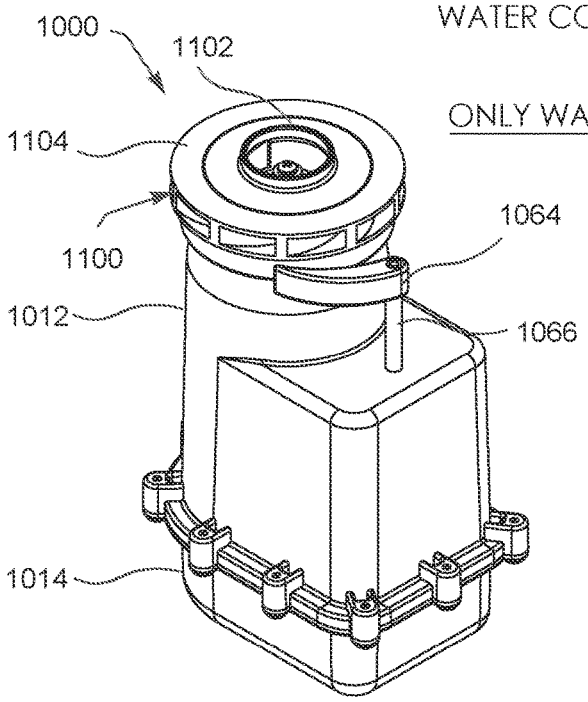
FIGS. 42A-D present perspective and bottom views of the pump of FIG. 38 in air and water configurations.
Figure 42B:
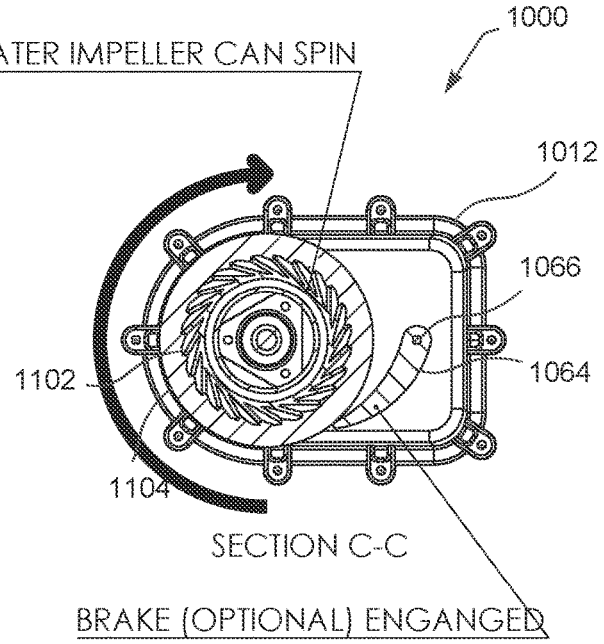
Figure 42C:
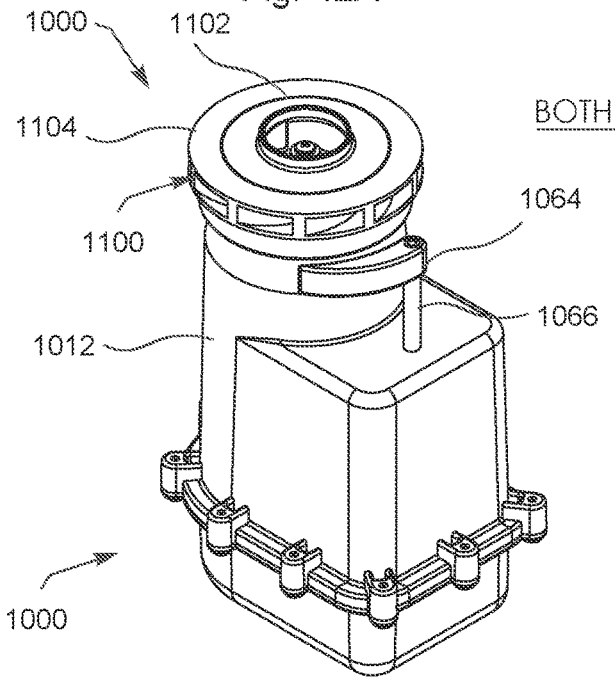
Figure 42D:
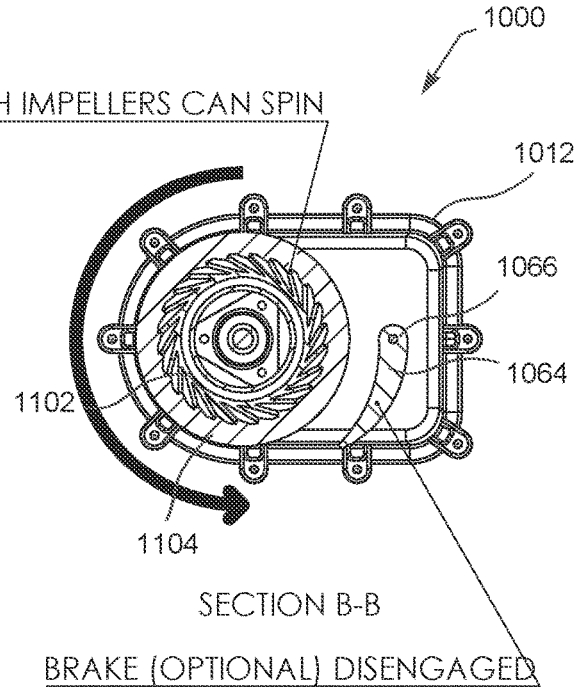
Figure 43:
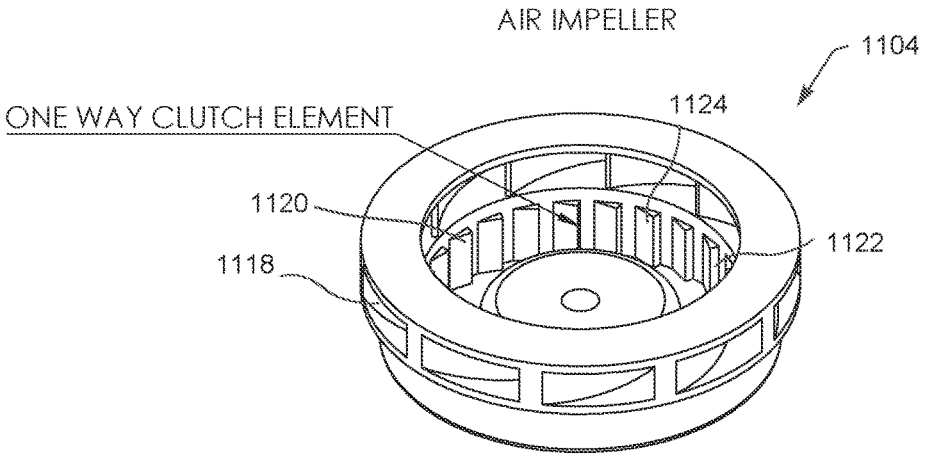
FIG. 43 is a perspective view of a portion of an impeller suitable for use in the pump of FIG. 38 having a one-way clutch element.
Figure 44:
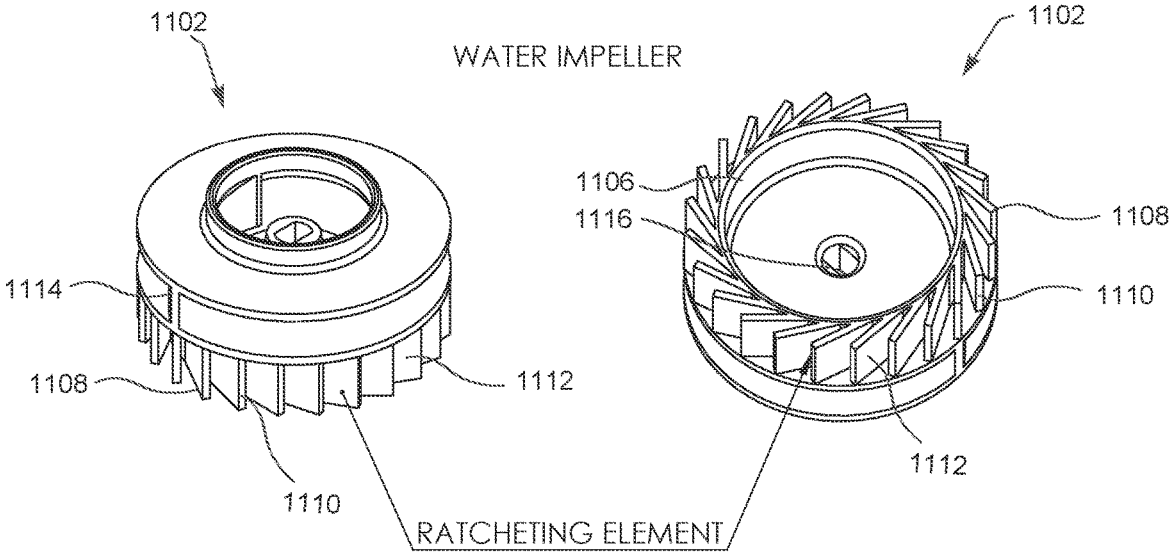
FIG. 44 presents top and bottom perspective views of another portion of an impeller suitable for use in the pump of FIG. 38 configured for selective engagement with the impeller portion of FIG. 43 and having a ratcheting element.

The impeller shaft (326) drives the impeller (324) and is driven by the clutch gear (360). In this embodiment, the impeller (324) is arranged for use in both air and water with a combination of features from each of the dedicated air and water impellers. An embodiment of the impeller (324) is included in FIG. 37, which illustrates a comparison among embodiments of a typical air impeller, a typical water impeller and an air/water impeller. Again, the use of air and water when describing the impellers should not be considered limiting, the impellers shown in FIG. 37 are only used as examples of impellers designed for specific mediums and a combination thereof. This embodiment of the impeller (324) is in a closed blade form with top (324*a*) and bottom (324*b*) plates. A series of curved blades (324*c*) is secured between these top and bottom plates. The curved blades (324*c*) do not extend completely to the core of the impeller (324) in these embodiments but may reach or extend past the core of the impeller as so desired. The curved blades (324*c*) are fewer in number than in an air impeller and greater in number than in a water impeller. The same impeller (324) is used in both air and water. Conceivably, one could use any impeller of any design for any medium. The forms presented should not be considered limiting to the scope of this disclosure. This type of impeller may be incorporated into other embodiments in which a single impeller is utilized.

A clutch spring (362) is provided around the impeller shaft (326) between the clutch gear (360) and an inner, bottom surface of the housing (312). This arrangement preferably results in the clutch spring (362) being able to raise or lower the clutch gear (360) relative to the housing (312) bottom depending on whether the clutch spring (362) is compressed or expanded.

Compression and expansion of the clutch spring (362) is a function of the medium within which the pump (300) is operating and the resulting difference in kinematic force exerted on the impeller (324) by the medium. More particularly, when a medium is being pulled in a direction by a vacuum pump, it exerts an opposite, reactionary force on the pulling element (the pump impeller), which results in the pulling element being pulled toward the medium. The differing properties of air and water result in each of those media exerting a greater (water) or lesser (air) opposing force on the pulling element. The greater force exerted by water on the impeller (324) pulls the impeller forward. This in turn pulls the impeller shaft (326), and with it the clutch gear (360), in the same direction. The clutch spring (362) compresses to accommodate this movement. As the impeller shaft (326) and clutch gear (360) are pulled toward the bottom of the housing (312), the clutch gear (360) moves into a position to engage the water impeller gear (356).

Of note, the clutch spring (362) is designed with a size and spring force that preferably result in the spring force being greater than the opposing force exerted by air on the impeller (324) but less than the opposing force exerted by water on the impeller (324). In this manner, the clutch spring (362) may be compressed when the pump (300) is operating in water but can expand and exert an upward force on the clutch gear (360) when the pump (300) is operating in an air environment. As a result, when the pump (300) is operating in an air environment, the clutch spring (362) expands and pushes the clutch gear (360) into its upper position in which it engages the air impeller gear (358). In an alternate embodiment, the spring arrangement may be implemented in reverse to achieve the same effect, utilizing a spring that pulls clutch gear (360) when the pump is operating in an air environment. Again, the descriptions of these mechanisms are not to be considered limiting.

Figure 22:
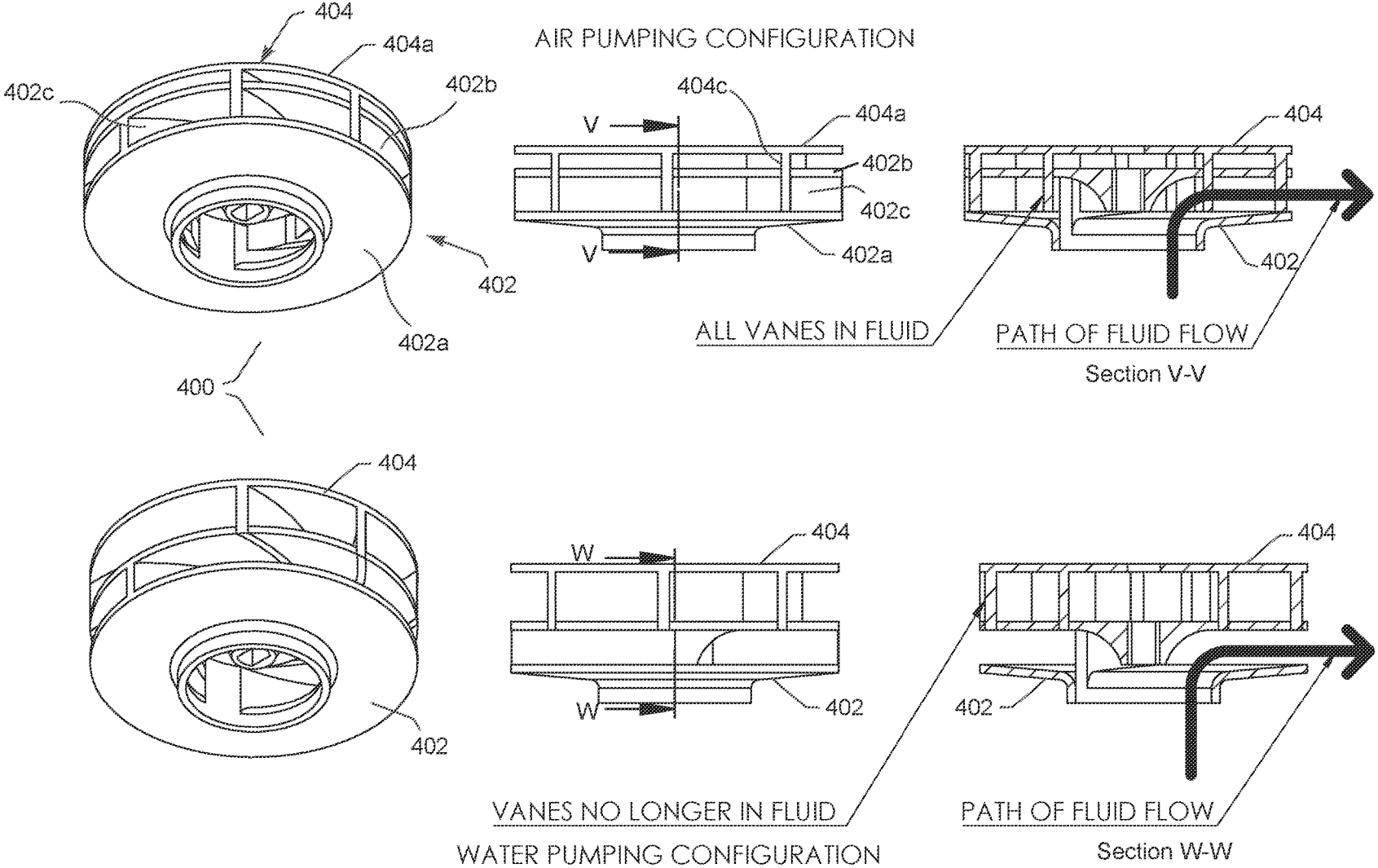
FIG. 22 presents views of the variable configuration impeller of FIG. 19 in its different configurations.
Figure 23:
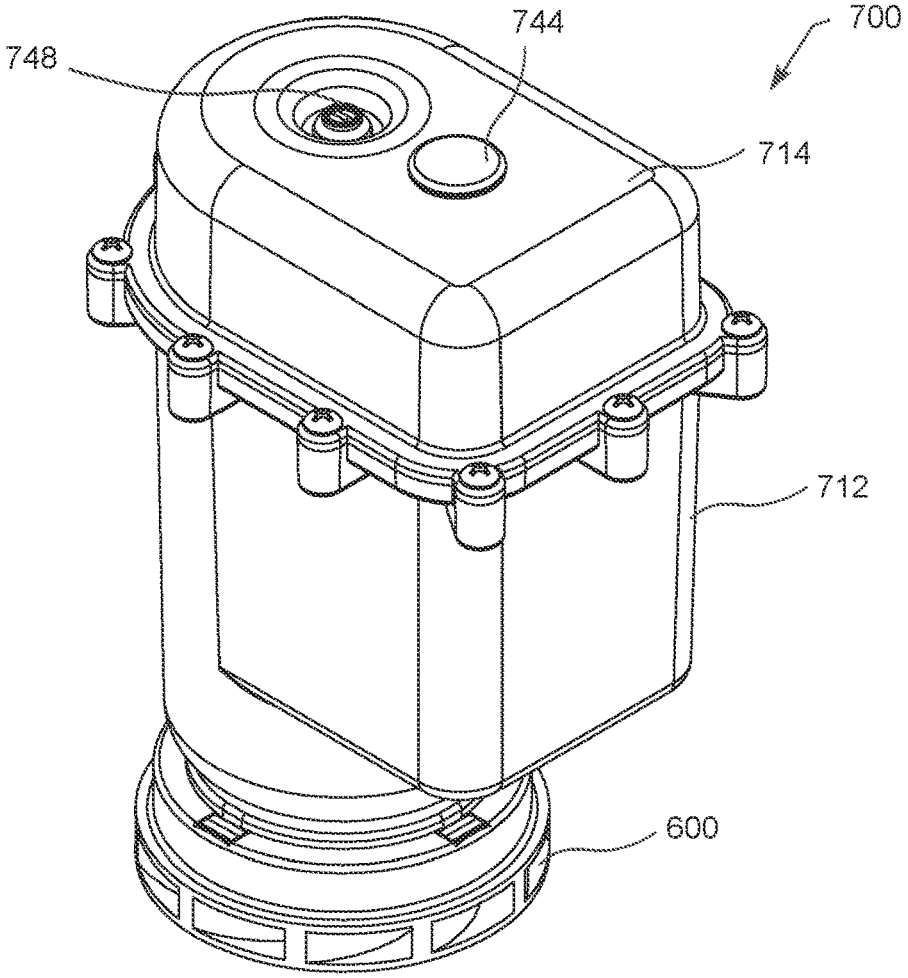
FIG. 23 is a perspective view of a fluid vacuum pump incorporating one motor and a variable configuration impeller according to another embodiment of the present disclosure.
Figure 24:
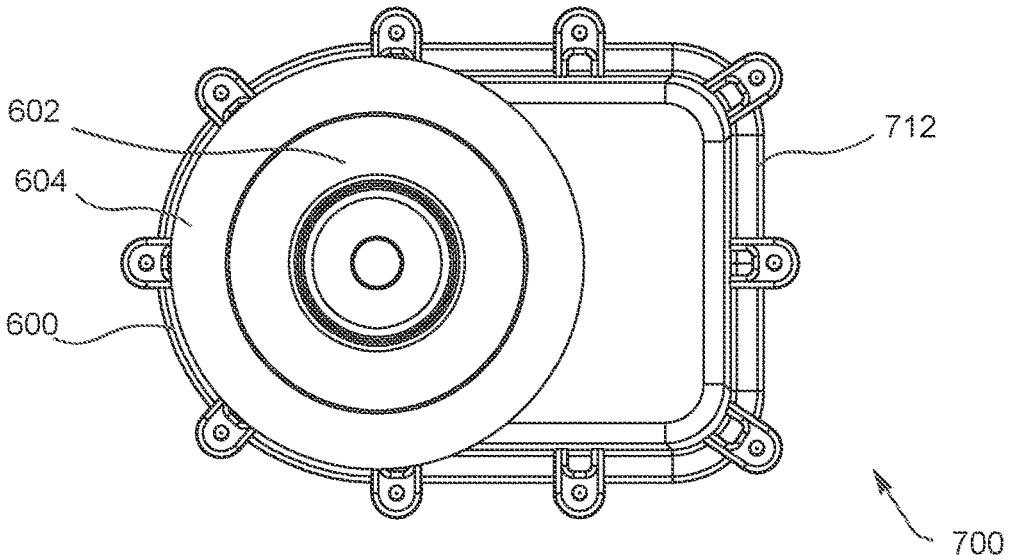
FIG. 24 is a bottom view of the fluid vacuum pump of FIG. 23
Figure 25A:
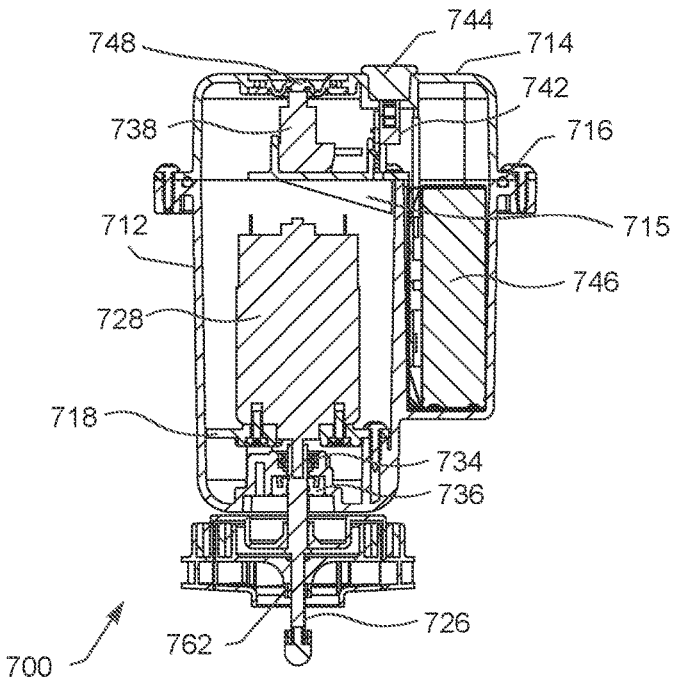
FIG. 25A is a first cross-section of the fluid vacuum pump taken along the section line H-H of FIG. 25 showing the pump in an air configuration.
Figure 25:
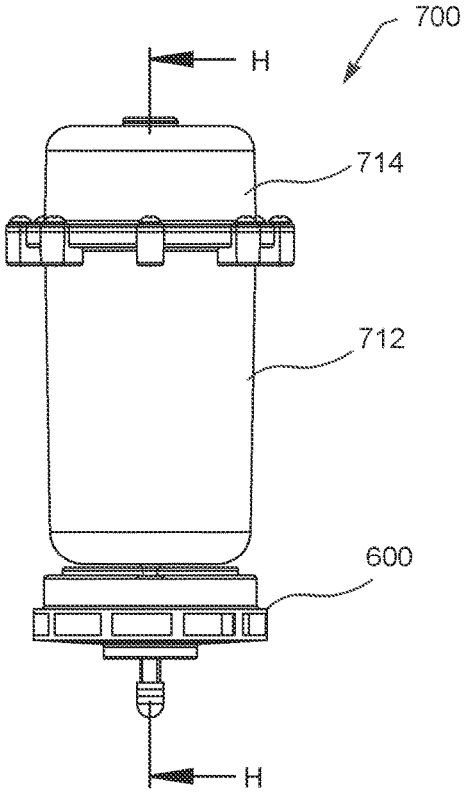
FIG. 25 is a side view of the fluid vacuum pump of FIG. 23.
Figure 25B:
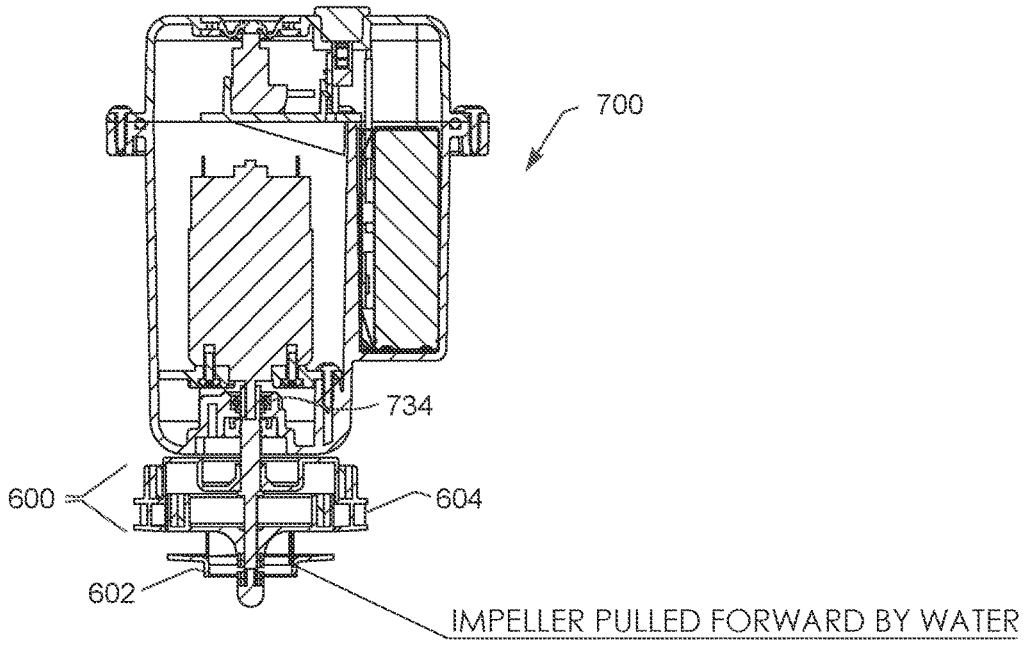
FIG. 25B is a second cross-section of the fluid vacuum pump taken along the section line H-H of FIG. 25 showing the pump in a water configuration.
Figure 26A:
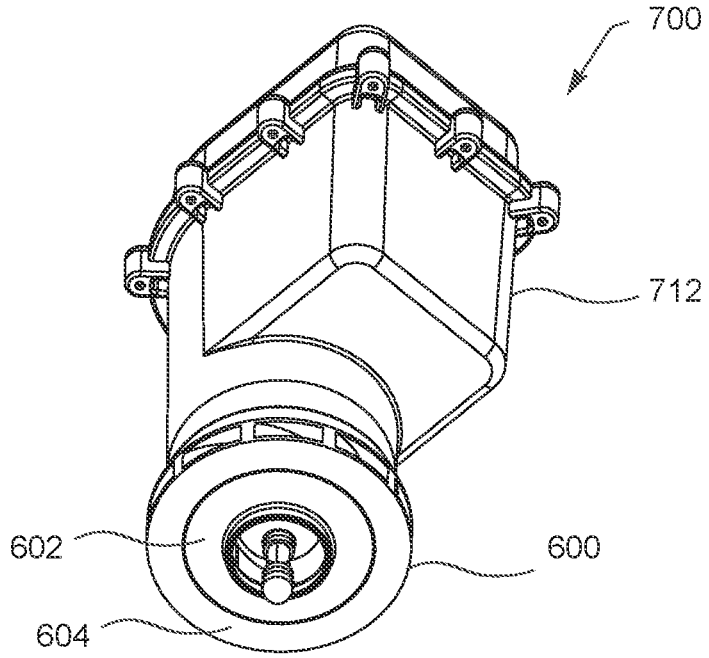
FIG. 26A is a bottom perspective view of the fluid vacuum pump of FIG. 23 showing the pump in an air configuration.
Figure 26B:
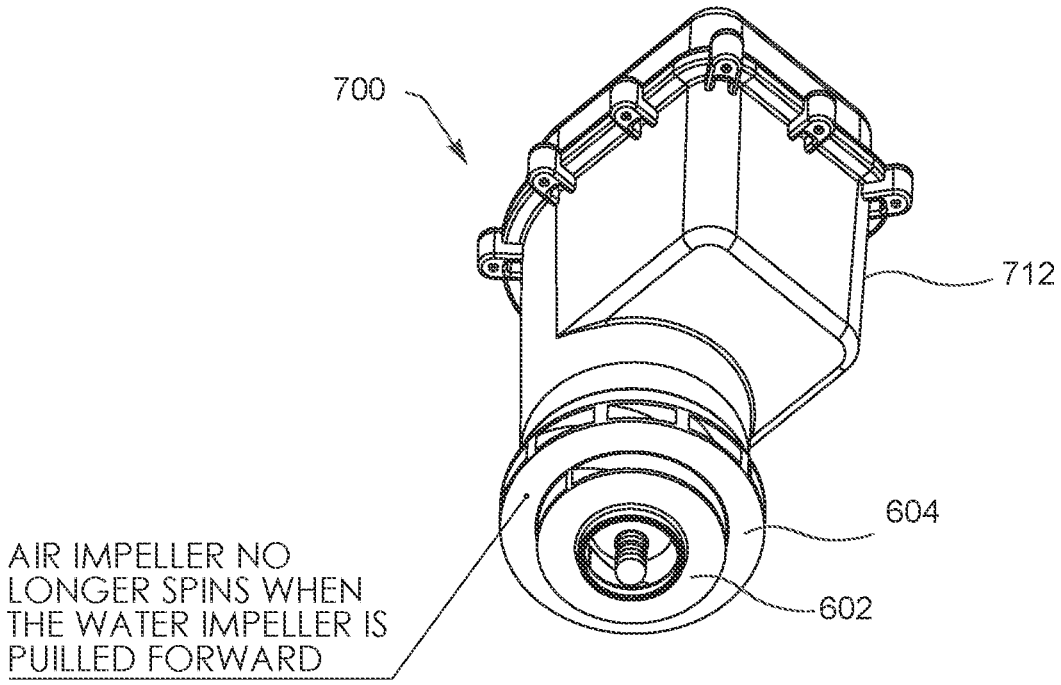
FIG. 26B is a bottom perspective view of the fluid vacuum pump of FIG. 23 showing the pump in a water configuration.
Figure 27:
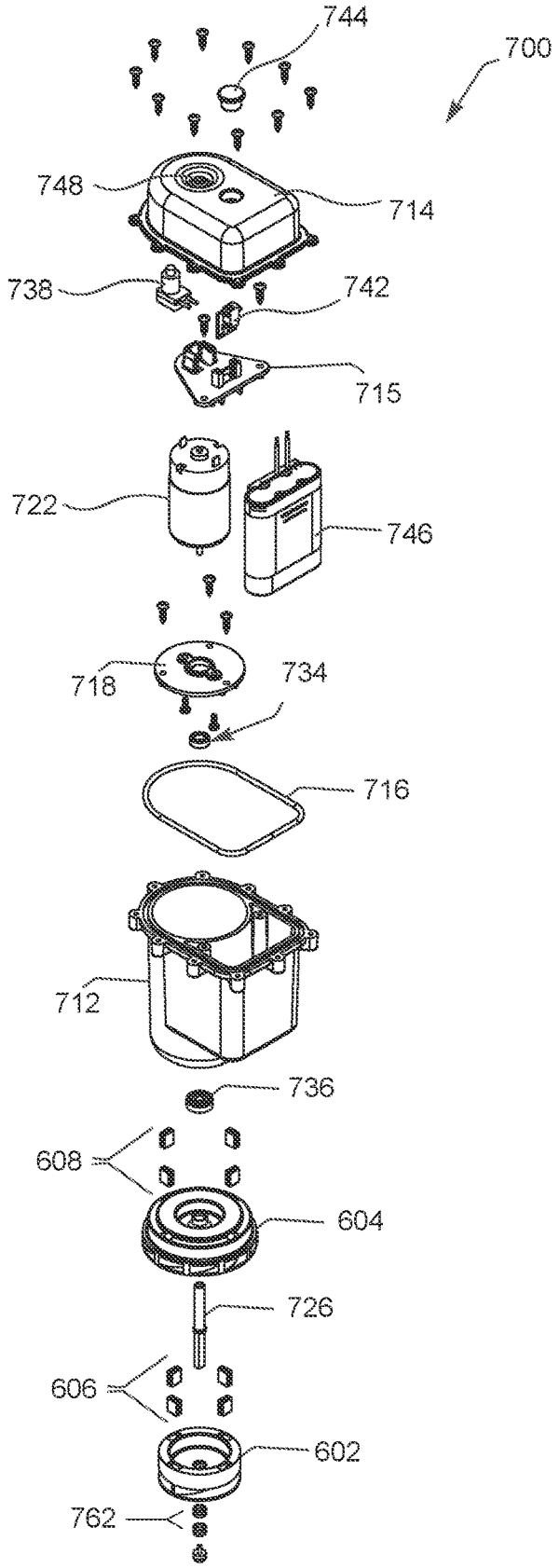
FIG. 27 is an exploded perspective view of the fluid vacuum pump of FIG. 23.
Figure 28:
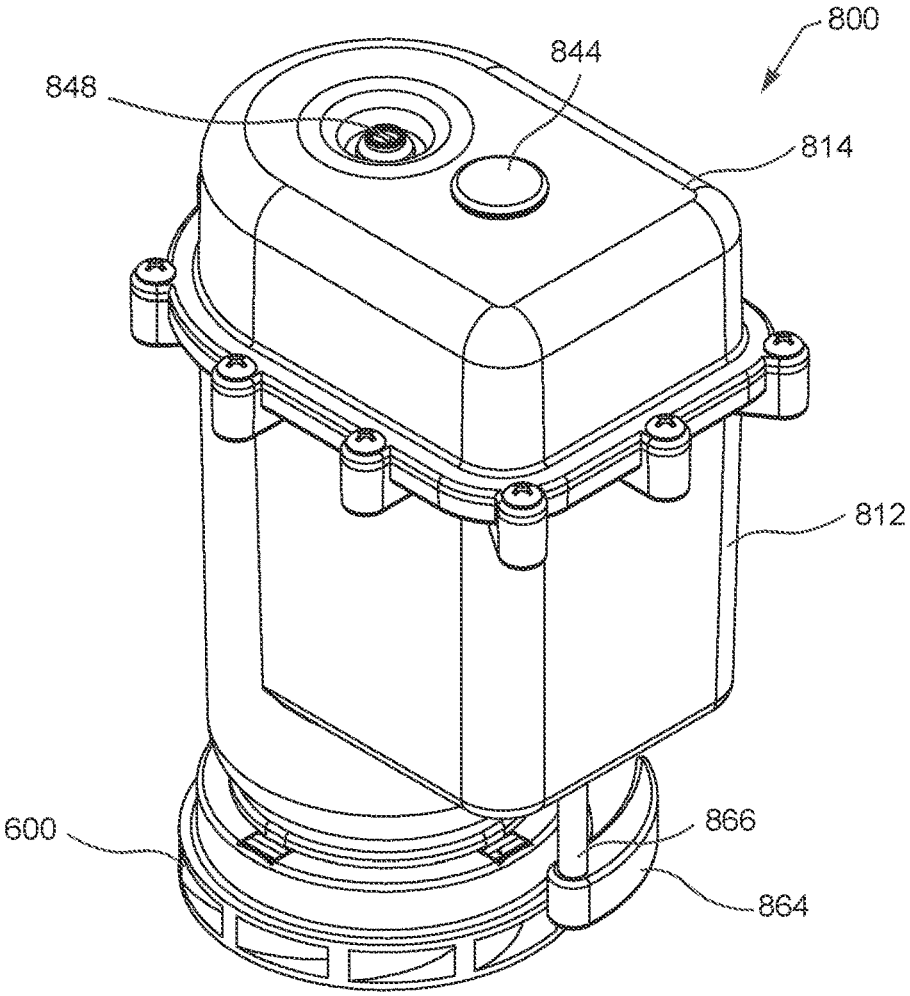
FIG. 28 is a perspective view of a fluid vacuum pump incorporating one motor and a varable configuration impeller according to another embodiment of the present disclosure.
Figure 29:
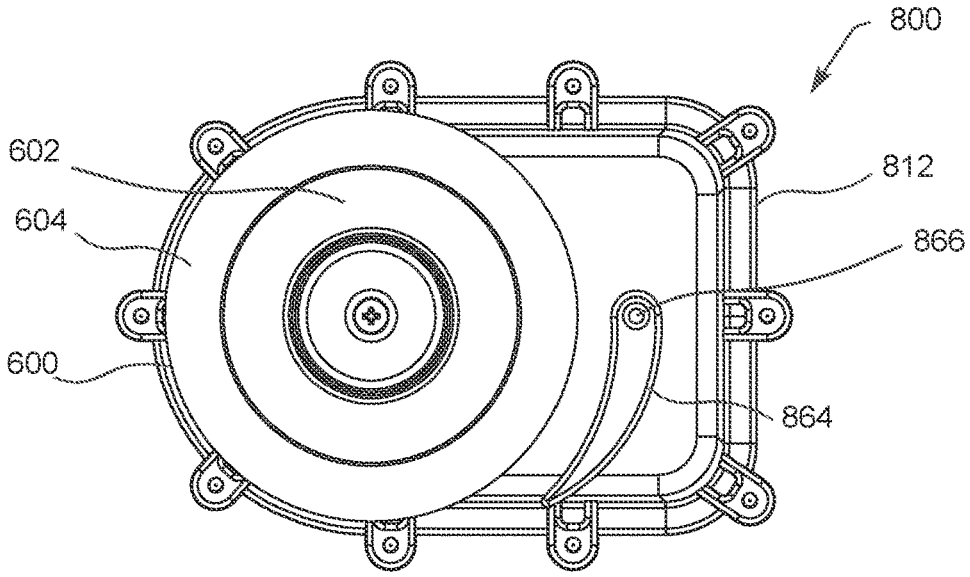
FIG. 29 is a bottom view of the fluid vacuum pump of FIG. 28.
Figure 30:
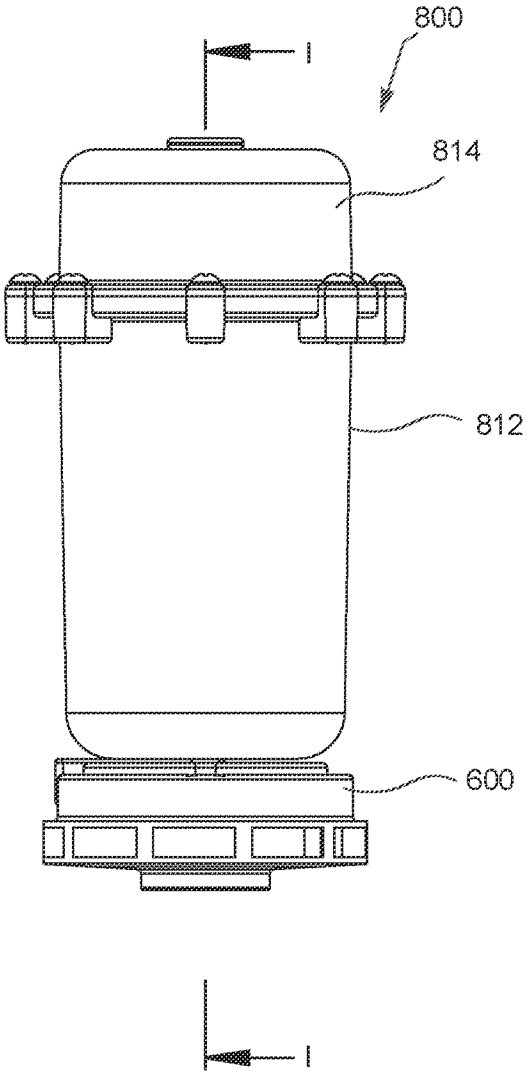
FIG. 30 is a side view of the fluid vacuum pump of FIG. 28.
Figure 30A:
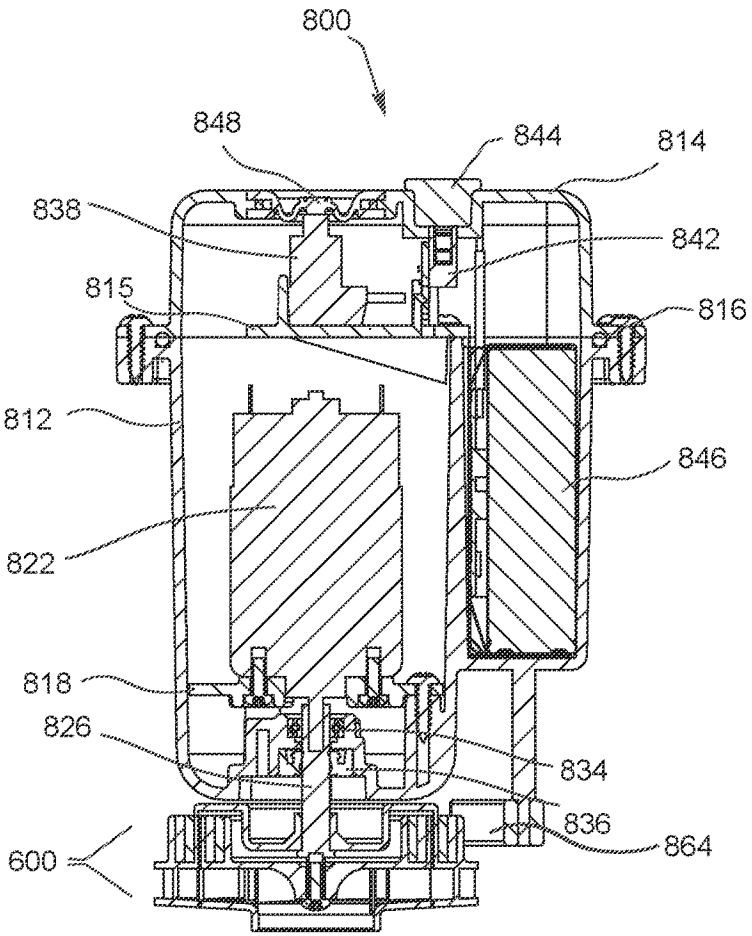
FIG. 30A is a cross-section of the fluid vacuum pump taken along the section line I-I of FIG. 30.
Figure 31:
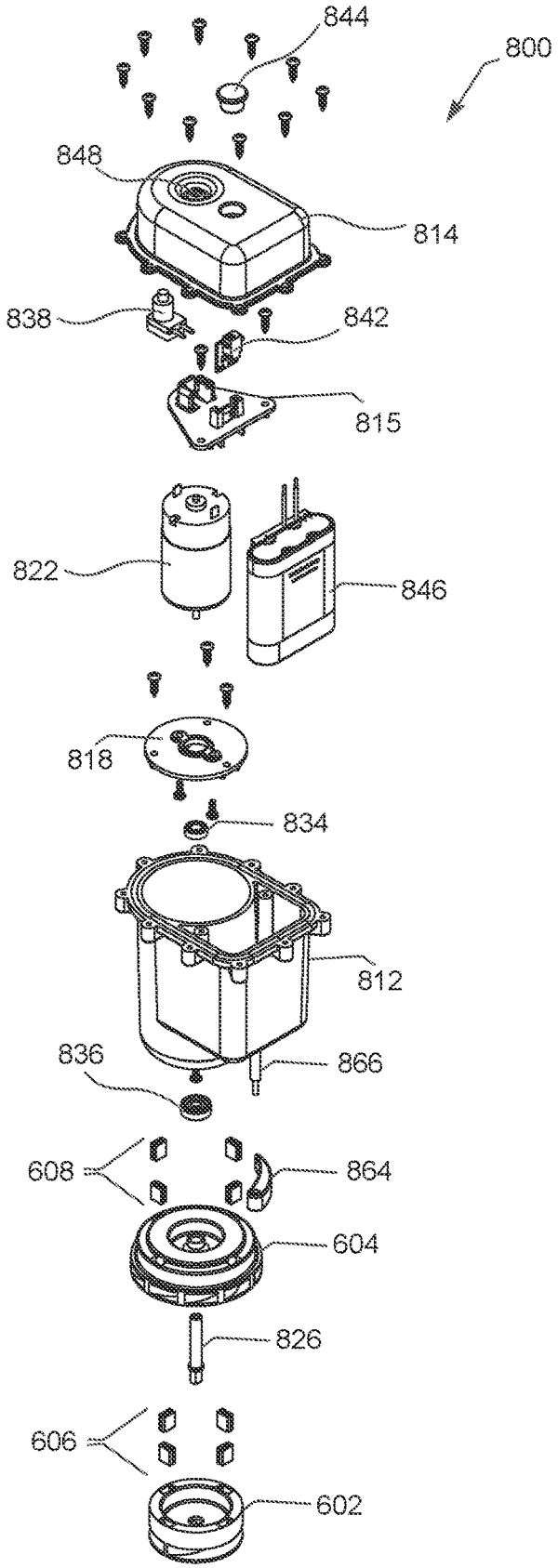
FIG. 31 is an exploded perspective view of the fluid vacuum pump of FIG. 28.
Figure 32A:
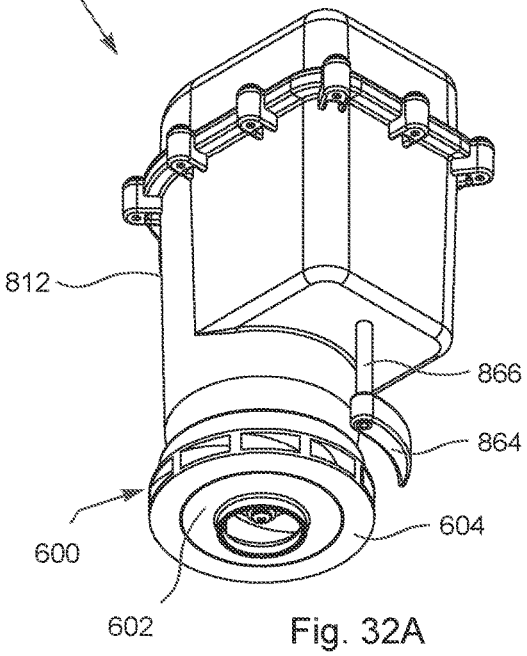
FIGS. 32A-D present perspective and bottom views of the pump of FIG. 28 in its air and water configurations.
Figure 32B:
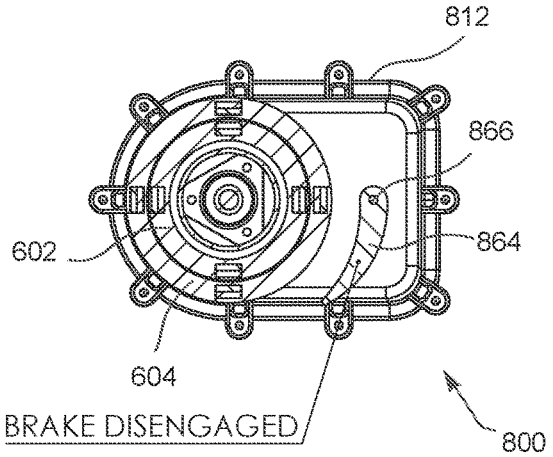
Figure 32C:
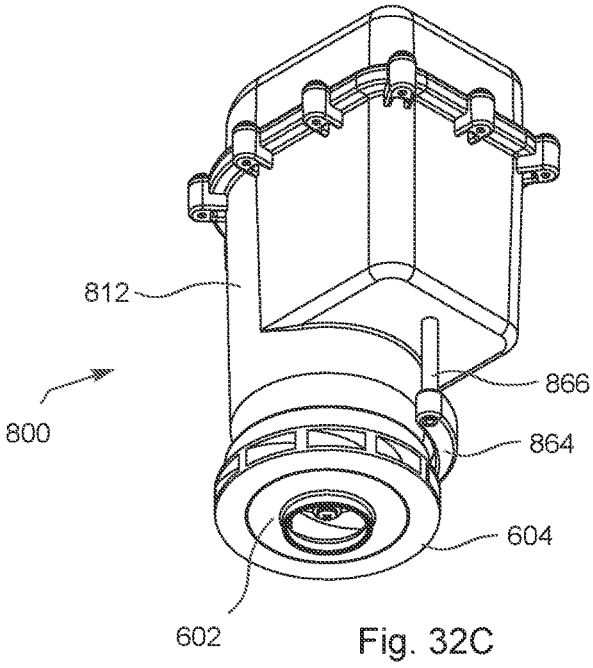
Figure 32D:
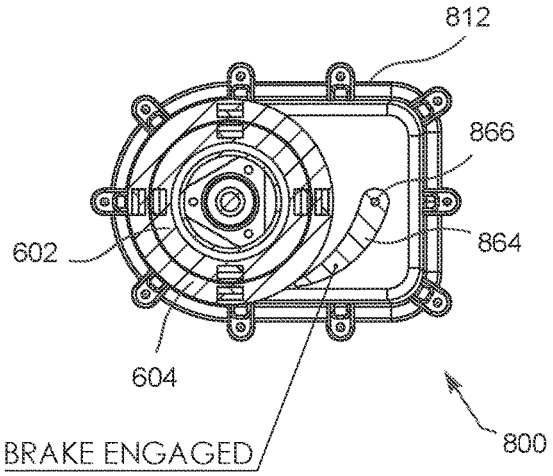
Figure 33:
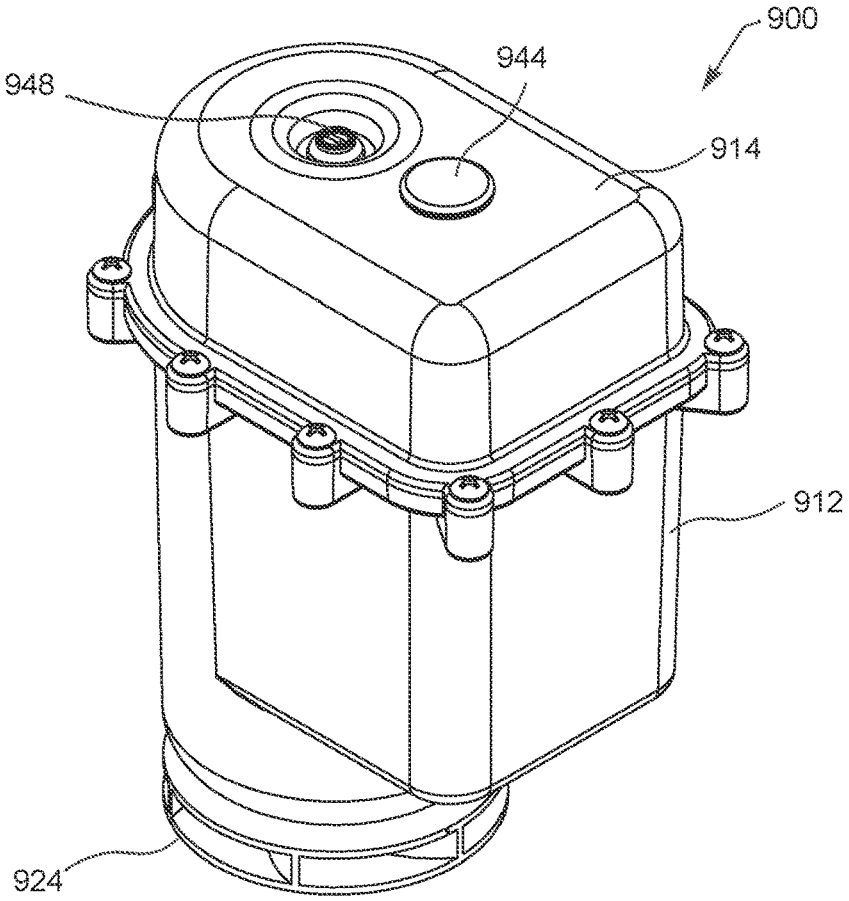
FIG. 33 is a perspective view of a fluid vacuum pump incorporating one motor and a varable configuration impeller according to another embodiment of the present disclosure.
Figure 34:
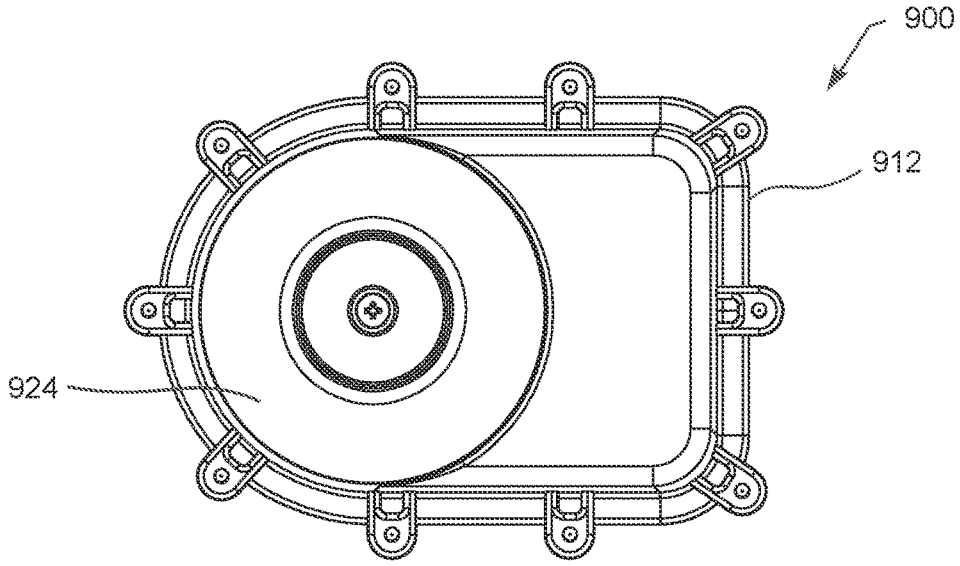
FIG. 34 is a bottom view of the fluid vacuum pump of FIG. 33
Figure 35:
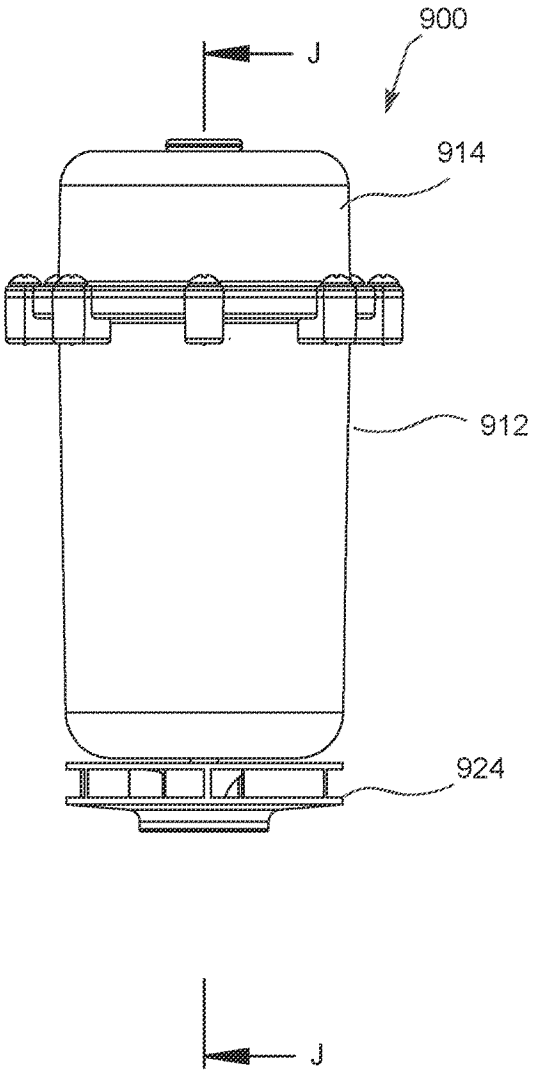
FIG. 35 is a side view of the fluid vacuum pump of FIG. 33.
Figure 35A:
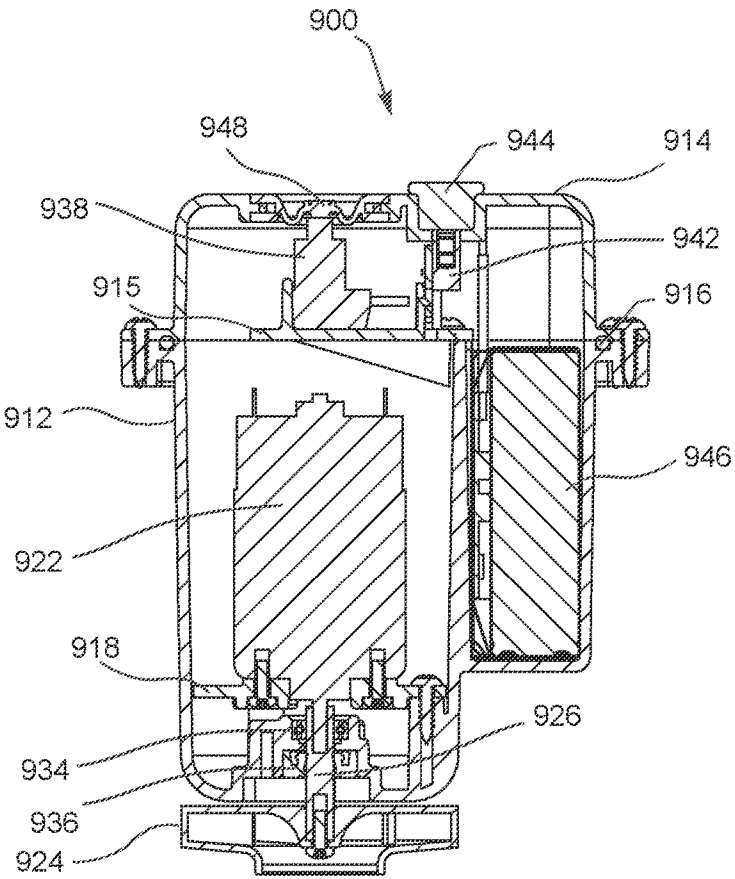
FIG. 35A is a first cross-section of the fluid vacuum pump taken along the section line J-J of FIG. 35.
Figure 36:
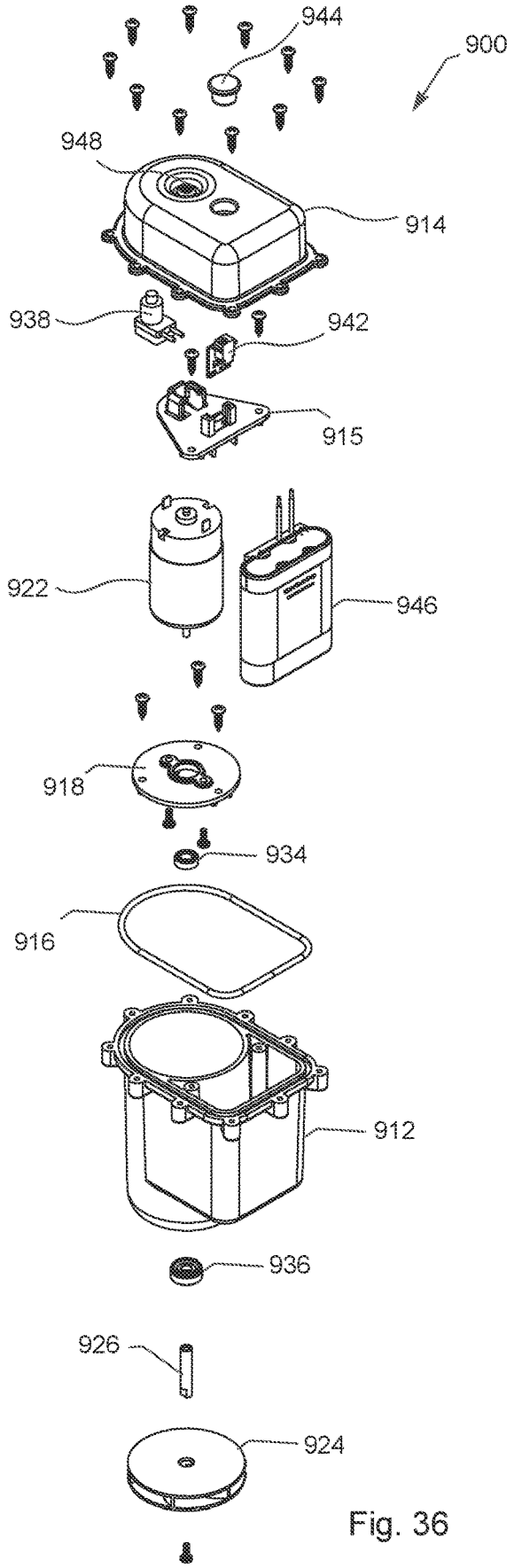
FIG. 36 is an exploded perspective view of the fluid vacuum pump of FIG. 33.

The embodiments illustrated in FIGS. 19-32 each employ elements for altering the structure of a single impeller depending upon the environment in which the pump is being used. In the case of the embodiment of FIGS. 19-22, the single impeller (400) has a two-part arrangement as shown, for example, in FIG. 22. First (402) and second (404) sections of the impeller (400) operate concentrically around an impeller shaft but may be axially moved relative to one another as shown.

The first section (402) may be provided with an alternate diameter than the second section (404). The first section (402) may have a closed blade form with top (402*a*) and bottom (402*b*) plates. A series of blades (402*c*) is secured between these top and bottom plates. The bottom plate (402*b*) may be provided with a series of curved slots (402*d*)—best seen in FIG. 21. These curved slots (402*d*) correspond in number, dimension, and orientation to the blades (404*c*) of the second section (404) and engage with those blades (404*c*) as described below.

The second section (404) is similarly provided with a bottom plate (404*a*) and a series of blades (404*c*) but preferably without a top plate. The blades (404*c*) of the second section (404) are preferably configured to provide optimal performance in air in its collapsed state. The blades (404*c*) are further arranged to be insertable into and through the curved slots (402*d*) of the first section (402).

As a result, the first (402) and second (404) sections may be moved between a first position in which the blades (404*c*) of the second section (404) pass through the curved slots (402*d*) of the first section (402) and the bottom plate (404*a*) of the second section (404) is pressed against the bottom plate (402*b*) of the first section (402) or more preferably the upper edges of blades (404*c*) of the second section (404) are pressed against the upper plate (402*a*) of the first section (402). In this position, the blades (402*c*, 404*c*) of both sections are able to operate together emulating a traditional air impeller. In a preferred embodiment, the combined blades of the first (402) and second (404) sections are arranged for optimal performance in an air environment. It can be seen that fluid (air) is drawn though the combined first and second sections of the impeller (400).

In contrast, in a second position in which the blades (404*c*) of the second section (404) are retracted from the curved slots (402*d*) of the first section (402), the two sections may not cooperate with one another and one of the sections may be used alone. In an alternate embodiment the second section may still spin but is removed from the flow of fluid. In the illustrated embodiment, fluid (water) is drawn only through the first section (402). Note that the respective blade and plate arrangement of the impeller sections may be reversed.

The variable impeller pump (500) of FIGS. 19-22 utilizes a clutch spring (562) in a manner somewhat similar to that described in connection with the two-motor/single-impeller pump (300) described above. More particularly, the operation of the clutch spring (562) derives from the differing kinematic forces exerted on the impeller by air and water. The impeller shaft (526) is provided with a narrowed section that is surrounded by larger dimensioned sections both above and below this narrowed section.

The first impeller section (402) is slidably mounted on the narrower section of the impeller shaft (526), which has a length greater than the thickness of the first impeller section (402). The center aperture of the first impeller section (402) is sized to allow for sliding engagement with the narrowed section of the impeller shaft (526) but is smaller in dimension than the larger sections of the impeller shaft (526) located above and below the narrowed section of the shaft (526). This arrangement provides for a sliding range of movement of the first impeller section (402) along only the narrowed section of the impeller shaft (526) controlled by the action of the clutch spring (562) with the larger dimensioned sections of the impeller shaft (526) serving as upper and lower limits for the range of movement of the first impeller section (402).

In this case, the impeller shaft (526) is inserted through a center aperture of the second impeller section (404), and the second impeller section (404) is held in a relatively constant axial relationship with the impeller shaft (526) by elements of the housing (512) and/or features of the impeller shaft (526). The second impeller section (404) is left to spin freely around the impeller shaft (526). Thus, the second impeller section (404) is never driven directly by the impeller shaft (526). Instead, the second impeller section (404) is driven only by the first impeller section (402) as a result of the blades (404*c*) of the second impeller section (404) engaging the curved slots (402*d*) of the first impeller section (402). However, in alternate embodiments, the second impeller section (404) may be driven by the impeller shaft (526).

This engagement is selectively created by the clutch spring (562) and the kinematics acting on the impeller (400). The greater force exerted by water on the impeller (400) pulls the first impeller section (402) towards the medium (away from pump body), thereby disengaging the blades (404*c*) of the second impeller section (404) from the curved slots (402*d*) of the first impeller section (402). The second impeller section (404), now being disengaged from the first impeller section (402) and not being driven by the impeller shaft (526), becomes a non-functional part of the pumping action. This leaves the first impeller section (402), with its blades (402*c*) being configured for water performance, as the only active pumping component. In an alternate embodiment where the second impeller section (404) is still driven by the impeller shaft (526), positioning the second impeller section (404) axially further away from the flow allows it to become a non-functional part of the pumping action.

Again, the clutch spring (562) is designed with a size and spring force that preferably result in the spring force being greater than the opposing force exerted by air on the impeller but less than the opposing force exerted by water on the impeller. In this manner, the clutch spring (562) may be compressed when the pump (500) is operating in water but is allowed to expand and exert an upward force on the first impeller section (402) when the pump (500) is operating in an air environment. As a result, when the pump (500) is operating in an air environment, the clutch spring (562) expands and forces the first impeller section (402) toward the second impeller section (404), thereby allowing the blades (404*c*) of the second impeller section (404) to engage the curved slots (402*d*) of the first impeller section (402). In this position, the first impeller section (402) is able to drive rotation of the second impeller section (404) and the blades of the two sections may combine to more effectively draw air into the pump (500).

Note that due to the different arrangement of the battery (546) within the housing (512), that the components located immediately beneath the cover (514) are supported by plate (515).

The embodiments of FIGS. 23-32 also utilize a variable configuration impeller (600) but of a design somewhat different from the preceding embodiment. An equivalent of the first impeller section (configured for use in water) (602) represents a core of the impeller (600), while the second impeller section (configured for use with the first impeller section in air) (604) is peripheral to the first impeller section (602). Rather than engagement of blades and slots, the first and second impeller sections are selectively engaged by a series of magnets associated with each section. In alternate embodiments, a friction torque clutch may be used instead of magnets, and the method of engagement should not be considered limiting. A first set of magnets (606) are affixed to the first impeller section (602). A second set of magnets (608) are affixed to the second impeller section (604). The first (606) and second (608) set of magnets are provided with attracting polarity such that they cooperate to magnetically link the first (602) and second (604) impeller sections in a coplanar and concentric configuration in which the impeller sections move together with one another. It is the magnetic field strength connecting the first (606) and second (608) sets of magnets that results in the second impeller section (604) being driven by the first impeller section (602).

In the embodiment of FIGS. 23-27, the second (air) impeller section (604) is mounted in a free-spinning manner on the impeller shaft (726) and is held in a relatively constant axial position relative to the impeller shaft (726). A spring (762) positioned adjacent to the outer end of the impeller shaft (726) exerts a force biasing on the first impeller section (602) toward the second impeller section (604). The spring (762) could also be composed of magnets with opposing polarity, a rubber spacer, or any of the like. The composition and design of spring (762) should not be considered limiting.

As in the preceding embodiment, the engagement of the first (602) and second (604) impeller sections is controlled through the kinematic action of the medium being pumped. However, whereas in the previous embodiment it was a clutch spring that was configured to coordinate with that kinematic action, in this embodiment the magnetic field force of the first (606) and second (608) sets of magnets, along with spring (762), is calibrated relative to the differing kinematic forces exerted by air and water. In an alternate embodiment springs may be used, torque clutches may be used, or any conceivable linking system may be implemented as desired. The linking system should not be considered limiting. More particularly, when pumping water, the magnetic field strength—and the spring force of the spring (762)—are preferably less than the kinematic force exerted on the impeller (600) by the water. This results in the first impeller section (602) breaking away from the second impeller section (604) such that the second impeller section (604) is no longer magnetically coupled with, nor driven by, the first impeller section (602).

In an air environment, the kinematic force exerted on the impeller (600) is no longer sufficient to break the magnetic attraction of the first (606) and second (608) sets of magnets or overcome the spring force of the spring (762). Thus the spring (762) forces the first impeller section (602) toward the second impeller section (604) where the first (606) and second (608) sets of magnets may again form a magnetic coupling between the first (602) and second (604) impeller sections such that the second impeller section (604) is again driven with the first impeller section (602).

The pump embodiment (800) illustrated in FIGS. 28-32D utilizes the same impeller (600) arrangement. However, in this embodiment, the first impeller section (602) is not axially moveable relative to the second impeller section (604) and, therefore, the first (602) and second (604) impeller sections remain in a coplanar arrangement during all operation of the pump (800). For that reason, no axially acting spring or other mechanism is used. Only the first impeller section (602) is engaged with and driven by the impeller shaft (826).

In order to control rotation of the second impeller section (604), a brake or any conceivable stopping element (864) is provided that acts on the circumferential surface of the second impeller section (604). The brake (864) is pivotable about a pivot post (866) along an arc. At one end of the arc, the distal end of the brake (864) engages the second impeller section (604) to restrict its motion and break the connection between the magnets (606, 608), thus allowing the first impeller section (602) to be driven and pump by itself. When the brake (864) is moved away from the second impeller section (604), the magnets (606, 608) can maintain the magnetic coupling between the two impeller sections (602, 604) and allow the second impeller section (604) to be driven with the first impeller section (602). The brake (864) may be arranged to engage the circumferential surface of the second impeller section (604) frictionally, by latching against one of the blades of the second impeller section (604), or by any other conceivable method to prevent rotation of the second impeller section (604). The form or presence of a braking element should not be considered limiting to this disclosure.

It is worth noting that an impeller may be designed to resist rotation as the density of a fluid increases. For instance, an outer ring impeller may be designed such that when water passes through the impeller vanes, torque generated by the water on the impeller vanes may slow or stop the impeller element from spinning. Conceivably the inner impeller could be designed in a similar manner where water slows or stops said impeller while the outer impeller remains functional and unaffected by the presence of a different fluid. In any case the impeller may be able to slow down due to the presence of a fluid with differing properties. As such, in alternate embodiments, a brake may not be utilized while still maintaining the intended functionality of the invention and should not be considered limiting.

FIGS. 33-36 illustrate a variation of a single motor/single impeller pump (900). In this embodiment, one motor (922) and one impeller (924) are employed. More particularly, the impeller (924) is arranged for use in both air and water with a combination of features from each of dedicated air and water impellers as described in previous embodiments. However, in this embodiment, the motor (922) is a brushless motor system configured to detect changes in current draw, torque, and/or rotational velocity of the impeller (924) resulting from the kinematic differences in pumping air versus water. The motor (922) adjusts operation of its RPM and torque output to best accommodate the relevant medium. The use of a brushless motor should not be considered limiting as other motors could also have adjustable output through the use of voltage, current, and frequency variations, pulse width modulation, and/or any other conceivable method.

FIGS. 38-44 illustrate yet another version of single motor, variable configuration impeller pump (1000). Similarly to the embodiment of FIGS. 28-32D, this embodiment may include an optional brake or other form of auxiliary structure (1064) that may be incorporated but is not essential to operation of the embodiment. Instead, operation of this embodiment is more focused on the impeller arrangement shown in FIGS. 43-44.

The impeller (1100) is again provided with a first impeller section (1102) and a second impeller section (1104). The first impeller section (configured for use in water) (1102) represents a core of the impeller (1100), while the second impeller section (configured for use with the first impeller section in air) (1104) is peripheral to the first impeller section (1102). The first impeller section (1102) is not axially moveable relative to the second impeller section (1104), and, therefore, the first (1102) and second (1104) impeller sections remain in a coplanar and concentric arrangement during operation of the pump (1100). Only the first impeller section (1102) is engaged with and driven by the impeller shaft (1026) by a shaft engagement structure (1116).

The first impeller section (1102) is provided with a series of ratcheting elements (1108). The ratcheting elements (1108) are arranged around a portion of the circumference of the first impeller section (1102) and may be attached to a central, annular support wall (1106) although other means of supporting the ratcheting elements (1108) may be utilized. The ratcheting elements (1108) preferably have at least one engagement surface (1110) at their outer portion that is configured to engage with a corresponding portion of the second impeller section (1104) as described below. The ratcheting elements (1108) may also be provided with a sloped surface (1112). The ratcheting elements (1108) may be configured such that their engagement surfaces (1110) will engage with the corresponding portion of the second impeller section (1104) in some form of interference relationship with the second impeller section (1104). When the first impeller section (1102) turns in a first direction, it forces the second impeller section (1104) to spin with the first impeller section (1102). A "bypass" relationship can form in which the sloped surfaces (1112) of the first impeller section (1102) engage a corresponding portion of the second impeller section (1104) to allow the first impeller section (1102) to spin on its own without substantial engagement with the second impeller section (1104) when the first impeller section (1102) is driven in a second direction.

A different portion of the periphery of the first impeller section (1102) may be provided with a series of blades (1114) that operate as described in a manner similar to corresponding portions of the other impellers described herein and as otherwise known. Alternately, the blades (1114) of the first impeller section (1102) may be incorporated with the ratcheting elements (1108).

The second impeller section (1104) is also provided with a series of blades (1118) along its periphery. A series of one-way clutch elements (1120) are provided along an inner surface of the second impeller section (1104). Each one-way clutch element (1120) may be provided with an engagement surface (1122) that corresponds to the engagement surface (1110) of the ratcheting elements (1108) of the first impeller section (1102). The engagement surface (1122) of each one-way clutch element (1120) is oriented in an opposing direction to the engagement surfaces (1110) of the ratcheting elements (1108). The one-way clutch elements (1120) are also provided with a sloped surface (1124) that corresponds to the sloped surfaces (1112) of the ratcheting elements (1108).

When the first impeller section (1102) is turned in the first direction by the shaft (1026), the engagement surfaces (1110) of the ratcheting elements (1108) come into contact with the engagement surfaces (1122) of the one-way clutch elements (1120). The orientation of the ratcheting element engagement surfaces (1110) is such that they cannot slide past the one-way clutch element engagement surfaces (1122) but instead exert a force on the one-way clutch element engagement surfaces (1122), thereby rotationally driving the second impeller section (1104). However, when the first impeller section (1102) is turned in the second direction, it is the sloped surfaces (1112) of the ratcheting elements (1108) that make contact with the sloped surfaces (1124) of the one-way clutch elements (1120). This engagement of opposing sloped surfaces allows the ratcheting elements (1108) to slide past the one-way clutch elements (1120) without fully engaging them. As a result, the first impeller section (1102) may be allowed to spin without driving the second impeller section (1104).

In versions of this embodiment that do incorporate an optional brake (1064), it is pivotable about a pivot post (1066) along an arc. At one end of the arc, the distal end of the brake (1064) engages the second impeller section (1104) to aid in the restriction of motion and breaking of the connection between the second impeller section (1104) relative to the first impeller section (1102), again, in a supplementary manner. More particularly, the brake (1064) may be arranged to engage the circumferential surface of the second impeller section (1104) frictionally, by latching against one of the blades of the second impeller section (1104), or by any other conceivable method. Again, the form or presence of a braking element should not be considered limiting to this disclosure.

Alternate embodiments of the systems using the clutching mechanism are also envisioned. One such system is when the clutching mechanism is between the air impeller and the housing in which the housing prevents the air impeller from spinning in one direction. The location and configuration of clutching elements or methods should not be considered limiting and may apply to any of the embodiments described herein.

It should be noted that in the preceding embodiments, the housing, motor and battery are shown in a somewhat different relational arrangement compared to the previously discussed embodiments. This is a result only of the reduced interior space requirements produced by the use of a single motor, single impeller, and absence of a clutch mechanism. While this arrangement may be preferable, the particular arrangement of the housing, motor(s), and battery may be varied in each of the disclosed embodiments without departing from the scope of the present disclosure.

In addition, while each of the embodiments expressly disclosed herein are described as incorporating internal batteries, and, more particularly, rechargeable batteries, other power systems, including non-rechargeable, replaceable, etc. batteries and an external wall electrical outlet with or without an AC/DC converter are also contemplated within the present disclosure. While an internal rechargeable battery pack represents a preferred embodiment, other power sources may be utilized without departing from the scope of the present disclosure.

The preferred embodiments of the invention have been described above to explain the principles of the invention and its practical application to thereby enable others skilled in the art to utilize the invention in the best mode known to the inventors. However, as various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by the above-described exemplary embodiment, but should be defined only in accordance with the following claims appended hereto and their equivalents.

The invention claimed is:

1. A fluid vacuum pump, comprising:

a single motor assembly further comprising one of:

a single motor; or at least a first motor and a second motor;

a single impeller assembly further comprising at least a first impeller and a second impeller; and a single linkage operatively connecting said single motor assembly and said single impeller assembly to transmit power from said single motor assembly to said single impeller assembly depending on whether said single impeller assembly is in a first medium or a different second medium; and at least one of a controller and a selection device configured to selectively adjust operation of at least one of said single motor assembly, said single impeller assembly, and said single linkage depending on whether said single impeller assembly is in said first medium or said second medium;

wherein said first medium is a liquid;

wherein said entire single impeller assembly is submersible and operable in both the first and second mediums and said fluid vacuum pump is operable to pump both of the first and second mediums, either simultaneously or alternately, while the single impeller assembly is submerged in at least one of the first and second mediums.

2. The fluid vacuum pump as set forth in claim 1, wherein said first motor is configured for operation when said single impeller assembly is in said first medium and said second motor is configured for operation when said single impeller assembly is in said second medium.

3. The fluid vacuum pump as set forth in claim 1, wherein said first impeller is configured for operation in said first medium, and said second impeller is configured for operation in said second medium.

4. The fluid vacuum pump as set forth in claim 1, wherein said single linkage further comprises at least one of a linking mechanism and a clutch mechanism configured to adjustably transmit power from said single motor assembly to said single impeller assembly.

5. The fluid vacuum pump as set forth in claim 1, wherein:

said single linkage is configured to operatively connect said first motor with said first impeller and to operatively connect said second motor with said second impeller; and wherein said selection device is configured to direct power to at least one of said first motor and said second motor depending on whether said single impeller assembly is in said first medium or said second medium.

6. The fluid vacuum pump as set forth in claim 1, wherein:

said first impeller further comprises a first impeller gear and said second impeller further comprises a second impeller gear; and said single linkage further comprises a movable clutch gear selectively engaging said single motor with said first impeller gear and said second impeller gear.

7. The fluid vacuum pump as set forth in claim 4, wherein said selection device is configured to direct movement of the at least one movable clutch gear depending on whether said single impeller assembly is in said first medium or said second medium.

8. The fluid vacuum pump as set forth in claim 6, further comprising a kinematic clutch directing movement of said at least one movable clutch gear between engagement with said first impeller gear and said second impeller gear.

9. The fluid vacuum pump as set forth in claim 1, wherein said single motor assembly further comprises a brushless motor system.

10. The fluid vacuum pump as set forth in claim 1, further comprising:

at least one sensor configured to detect whether said single impeller assembly is in said first medium or said second medium; and wherein said controller or said selection device is in communication with said at least one sensor and is configured to adjust transmission of power to said single motor assembly depending on said medium detected by said at least one sensor.

11. The fluid vacuum pump of claim 1, wherein said controller is configured to selectively and independently provide power to and initiate operation of said first motor and said second motor.

12. The fluid vacuum pump of claim 1, wherein said single linkage is configured to selectively adjust operation of said single motor assembly and said single impeller assembly depending on whether said single impeller assembly is in said first medium or said second medium.

13. The fluid vacuum pump of claim 1, wherein said selection device is operatively connected with said controller and comprises at least one of a medium sensor and a manual selector switch.

14. The fluid vacuum pump of claim 13, wherein said medium sensor is configured to distinguish between said first medium and said second medium to determine whether said single impeller assembly is in said first medium or said second medium, wherein said medium sensor is configured to transmit a signal to said controller as a function of whether said single impeller assembly is in said first medium or said second medium, and wherein said signal directs said controller to adjust operation of at least one of said single motor assembly, said single impeller assembly, and said single linkage as a function of whether said single impeller assembly is in said first medium or said second medium.

15. The fluid vacuum pump of claim 13, wherein said medium sensor is configured to distinguish between said first medium and said second medium to determine whether said single impeller assembly is in said first medium or said second medium, wherein said medium sensor is configured to transmit a signal to said controller as a function of whether said single impeller assembly is in said first medium or said second medium, and wherein said signal directs said controller to provide power to and initiate operation of at least one of said first motor and said second motor as a function of whether said single impeller assembly is in said first medium or said second medium.

16. The fluid vacuum pump of claim 13, wherein said manual selector switch comprises at least two settings, wherein a first setting directs said controller to adjust operation of at least one of said first single motor assembly, said single impeller assembly, and said single linkage when said single impeller assembly is in said first medium and a second setting directs said controller to adjust operation of at least one of said first single motor assembly, said single impeller assembly, and said single linkage when said single impeller assembly is in said second medium.

17. The fluid vacuum pump of claim 1, wherein the second medium is a gas, wherein said single linkage operatively connecting said single motor assembly and said single impeller assembly to transmit power from said single motor assembly to said single impeller assembly further depending on whether said single impeller assembly is in the first medium, the second medium, or a combination thereof.

18. A fluid vacuum pump, comprising:

a single motor assembly;

a single impeller assembly comprising at least a first impeller and a second impeller; and a single linkage selectively and adjustably transmitting power from said single motor assembly to said single impeller assembly depending on whether said impeller assembly is in a first medium or a different second medium;

wherein said first medium is a liquid;

wherein said entire single impeller assembly is submersible and operable in both the first and second mediums and said fluid vacuum pump is operable to pump both of the first and second mediums, either simultaneously or alternately, while the single impeller assembly is submerged in at least one of the first and second mediums.

19. The fluid vacuum pump as set forth in claim 18, wherein said single linkage further comprises a clutch mechanism configured to selectively and adjustably transmit power from said single motor assembly to said single impeller assembly.

20. The fluid vacuum pump as set forth in claim 18, wherein:

said single motor assembly comprises a first motor configured for operation when said single impeller assembly is in said first medium and a second motor configured for operation when said single impeller assembly is in said second medium;

said first impeller configured for operation when said single impeller assembly is in said first medium, and said second impeller configured for operation when said single impeller assembly is in said second medium;

said single linkage being configured to selectively:

connect said first motor with said first impeller when said single impeller assembly is in said first medium;

disconnect said first motor from said first impeller;

connect said second motor with said second impeller when said single impeller assembly is in said second medium;

disconnect said second motor from said second impeller; and a selection device configured to:

direct said single linkage to connect said first motor with said first impeller and to direct power to said first motor when said single impeller assembly is in said first medium; and direct said single linkage to connect said second motor with said second impeller and to direct power to said second motor when said single impeller assembly is in said second medium.

21. The fluid vacuum pump as set forth in claim 18, wherein:

said first impeller configured for operation in said first medium, and said second impeller configured for operation in said second medium; and wherein said single linkage is configured to selectively engage said single motor assembly with at least one of a first impeller gear and a second impeller gear.

22. The fluid vacuum pump of claim 18, wherein the second medium is a gas, wherein said single linkage selectively and adjustably transmitting power from said single motor assembly to said single impeller assembly further depending on whether said single impeller assembly is in the first medium, the second medium, or a combination thereof.

23. The fluid vacuum pump as set forth in claim 18, wherein said single motor assembly comprises a brushless motor system.

24. The fluid vacuum pump as set forth in claim 18, further comprising:

at least one sensor configured to detect whether said single impeller assembly is in said first medium or said second medium; and a selection device in communication with said at least one sensor and configured to adjust transmission of power to said single motor assembly depending on said medium detected by said at least one sensor.

25. A fluid vacuum pump, comprising:

a single motor assembly;

a single impeller assembly comprising at least a first impeller and a second impeller; and a selection device selectively and adjustably controlling at least one of said single motor assembly and said single impeller assembly depending on whether said single impeller assembly is in a first medium or a different second medium;

wherein said first medium is a liquid;

wherein said entire single impeller assembly is submersible and operable in both the first and second mediums and said fluid vacuum pump is operable to pump both of the first and second mediums, either simultaneously or alternately, while the single impeller assembly is submerged in at least one of the first and second mediums.

26. The fluid vacuum pump of claim 25, wherein the second medium is a gas, wherein said selection device selectively and adjustably controls at least one of said single motor assembly and said single impeller assembly further depending on whether said single impeller assembly is the first medium, the second medium, or a combination thereof.

* * * * *